US008152970B2

(12) United States Patent
Barkdoll et al.

(10) Patent No.: US 8,152,970 B2
(45) Date of Patent: Apr. 10, 2012

(54) METHOD AND APPARATUS FOR PRODUCING COKE

(75) Inventors: Michael P. Barkdoll, Knoxville, TN (US); Donald M. Watkins, Beloit, OH (US); Richard C. Retort, Edinburg, PA (US); Richard W. Westbrook, Knoxville, TN (US); Jerome A. Karnowski, Maryville, TN (US); Mark A. Ball, Richlands, VA (US)

(73) Assignee: SunCoke Technology and Development LLC, Lisle, IL (US)

( * ) Notice: Subject to any disclaimer, the term of this patent is extended or adjusted under 35 U.S.C. 154(b) by 1438 days.

(21) Appl. No.: 11/367,236

(22) Filed: Mar. 3, 2006

(65) Prior Publication Data

US 2007/0205091 A1 Sep. 6, 2007

(51) Int. Cl.
*C10B 39/00* (2006.01)

(52) U.S. Cl. ..... 201/39; 202/262; 202/227; 202/228; 202/230

(58) Field of Classification Search ..... 201/39; 202/262, 227, 228, 230; 414/152
See application file for complete search history.

(56) References Cited

U.S. PATENT DOCUMENTS

| | | | | | |
|---|---|---|---|---|---|
| 3,984,289 | A | * | 10/1976 | Sustarsic et al. | 202/262 |
| 4,083,753 | A | * | 4/1978 | Rogers et al. | 202/227 |
| 4,141,796 | A | * | 2/1979 | Clark et al. | 201/39 |
| 4,196,053 | A | * | 4/1980 | Grohmann | 202/227 |
| 4,211,608 | A | | 7/1980 | Kwasnoski et al. | |
| 4,213,489 | A | | 7/1980 | Cain | |
| 4,213,828 | A | * | 7/1980 | Calderon | 201/39 |
| 4,289,584 | A | * | 9/1981 | Chuss et al. | 201/39 |
| 4,366,029 | A | * | 12/1982 | Bixby et al. | 202/262 |
| 4,396,461 | A | * | 8/1983 | Neubaum et al. | 201/39 |
| 4,726,465 | A | * | 2/1988 | Kwasnik et al. | 202/230 |

* cited by examiner

*Primary Examiner* — Nina Bhat
(74) *Attorney, Agent, or Firm* — Luedeka Neely Group, PC

(57) ABSTRACT

A method and apparatus for quenching metallurgical coke made in a coking oven. The method includes pushing a unitary slab of hot coke onto a substantially planar receiving surface of a hot car. The hot car containing the coke is then transported to a quench car station. The unitary slab of hot coke is pushed onto a substantially planar receiving surface of a quench car at the quench car station. Quenching of the slab of hot coke is conducted in the quench car with a predetermine amount of water. After quenching, the quenched coke is dumped onto a receiving pad for collection thereof.

24 Claims, 33 Drawing Sheets

METHOD AND APPARATUS FOR PRODUCING COKE

FIELD

The disclosure relates to a method and apparatus for producing coke from coal and in particular to an improved methods and apparatus for quenching coke while reducing dusting problems associated with a coke making process.

BACKGROUND AND SUMMARY

Coke is a solid carbon fuel and carbon source used to melt and reduce iron ore in the production of steel. During an iron-making process, iron ore, coke, heated air and limestone or other fluxes are fed into a blast furnace. The heated air causes combustion of the coke which provides heat and a source of carbon for reducing iron oxides to iron. Limestone or other fluxes may be added to react with and remove the acidic impurities, called slag, from the molten iron. The limestone-impurities float to the top of the molten iron and are skimmed off.

In one process, known as the "Thompson Coking Process," coke used for refining metal ores is produced by batch feeding pulverized coal to an oven which is sealed and heated to very high temperatures for 24 to 48 hours under closely controlled atmospheric conditions. Coking ovens have been used for many years to covert coal into metallurgical coke. During the coking process, finely crushed coal is heated under controlled temperature conditions to devolatilize the coal and form a fused mass having a predetermined porosity and strength. Because the production of coke is a batch process, multiple coke ovens are operated simultaneously, hereinafter referred to as a "coke oven battery".

At the end of the coking cycle, the finished coke is removed from the oven and quenched with water. The cooled coke may be screened and loaded onto rail cars or trucks for shipment or later use or moved directly to an iron smelting furnace.

Coal particles or a blend of coal particles are charged into hot ovens on a predetermined schedule, and the coal is heated for a predetermined period of time in the ovens in order to remove volatiles from the resulting coke. The coking process is highly dependent on the oven design, the type of coal and conversion temperature used. Ovens may be adjusted during the coking process so that each charge of coal is coked out in approximately the same amount of time.

Once the coal is coked out, the coke is pushed from the coke oven into a hot car wherein the coke is broken up and quenched with water to cool the coke below its ignition temperature. The quenching operation must be carefully controlled so that the coke does not absorb too much moisture. Once it is quenched, the coke is screened and loaded into rail cars or trucks for shipment.

One of the problems associated with the coke making process is dusting problems associated with quenching the coke as it is discharged from the coke ovens. During discharge of the coke from the coke ovens, a slab of coke breaks up and drops into a hot car. As the coke drops into the hot car, a significant amount of coke dust is created. Elaborate dust collection systems have been devised to capture dust particles generated as the coke is pushed into the hot cars. In order to reduce the dusting problems associated with coal coking without significantly increasing coke oven cycle times, improved methods for quenching coke are needed.

In accordance with the foregoing need, the disclosure provides a method and apparatus for making coke from coal. The method includes pushing a unitary slab of hot coke onto a substantially planar receiving surface of a hot car. The hot car containing the coke is then transported to a quench car station. The unitary slab of hot coke is pushed onto a substantially planar receiving surface of a quench car at the quench car station. Quenching of the slab of hot coke is conducted in the quench car with a predetermined amount of water. After quenching, the quenched coke is dumped onto a receiving pad for collection thereof.

Another embodiment of the disclosure provides a method of making coke from coal. The method includes burning a bed of coal in a coking oven for a period of time and under reducing atmosphere conditions to provide a unitary bed of coke. A product door from a product end of a first coking oven and a hot car is positioned adjacent the product end of the first coking oven. The unitary bed of hot coke is pushed onto a substantially planar receiving surface of the hot car. The hot car containing the unitary of hot coke is moved to a quenching car station. The product door is reinstalled onto the product end of the first coking oven. In the quenching car station, the unitary bed of hot coke is pushed onto a substantially planar receiving surface of a quench car. The unitary bed of hot coke is quenched in the quench car with an amount of water sufficient to fracture substantially all of the unitary bed of hot coke and to cool the hot coke to a predetermined temperature. The quenched and cooled coke is dumped onto a coke receiving pad.

Still another embodiment of the disclosure provides a hot car for a coke oven. The hot car has a partially enclosed hot box having a substantially planar coke slab receiving surface. An elevation and translation mechanism is provided on the hot car for elevating the hot box and moving the hot box toward and away from the coke oven.

Still another embodiment provides a stationary pusher for pushing a substantially unitary coke slab off of a hot car onto a quench car. The pusher includes a water cooled ram head, a first arm attached to the ram head, and a second arm pivotally connected to the first arm. A gear drive mechanism provides a device for moving the first and second arms. A cooling spray system for cooling the hot car movably is attached adjacent to the ram head. A guiding track is provided for guiding movement of the second arm from a substantially vertical position to a substantially horizontal position.

Another embodiment provides a multifunction quench car having a tiltable receiving bed having a substantially fixed end wall, a substantially fixed side wall, a movable side wall and a movable end wall. A tilting mechanism is provided for tilting the receiving bed in a first direction for quenching coke and in a second direction for discharging quenched coke onto a coke receiving dock.

The method and apparatus described above provide unique advantages for coking operations. In particular, flat pushing of the coke onto a hot car significantly reducing an amount of coke dust generated during a coke oven discharge operation. Accordingly, dust collection equipment for collecting coke dust during the coke discharge operation may be substantially smaller and may provide higher dust collection efficiencies. Another advantage of the of the disclosed embodiments is that a consistently low moisture content of the coke may be achieved.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF EXEMPLARY EMBODIMENTS

Figure 1:
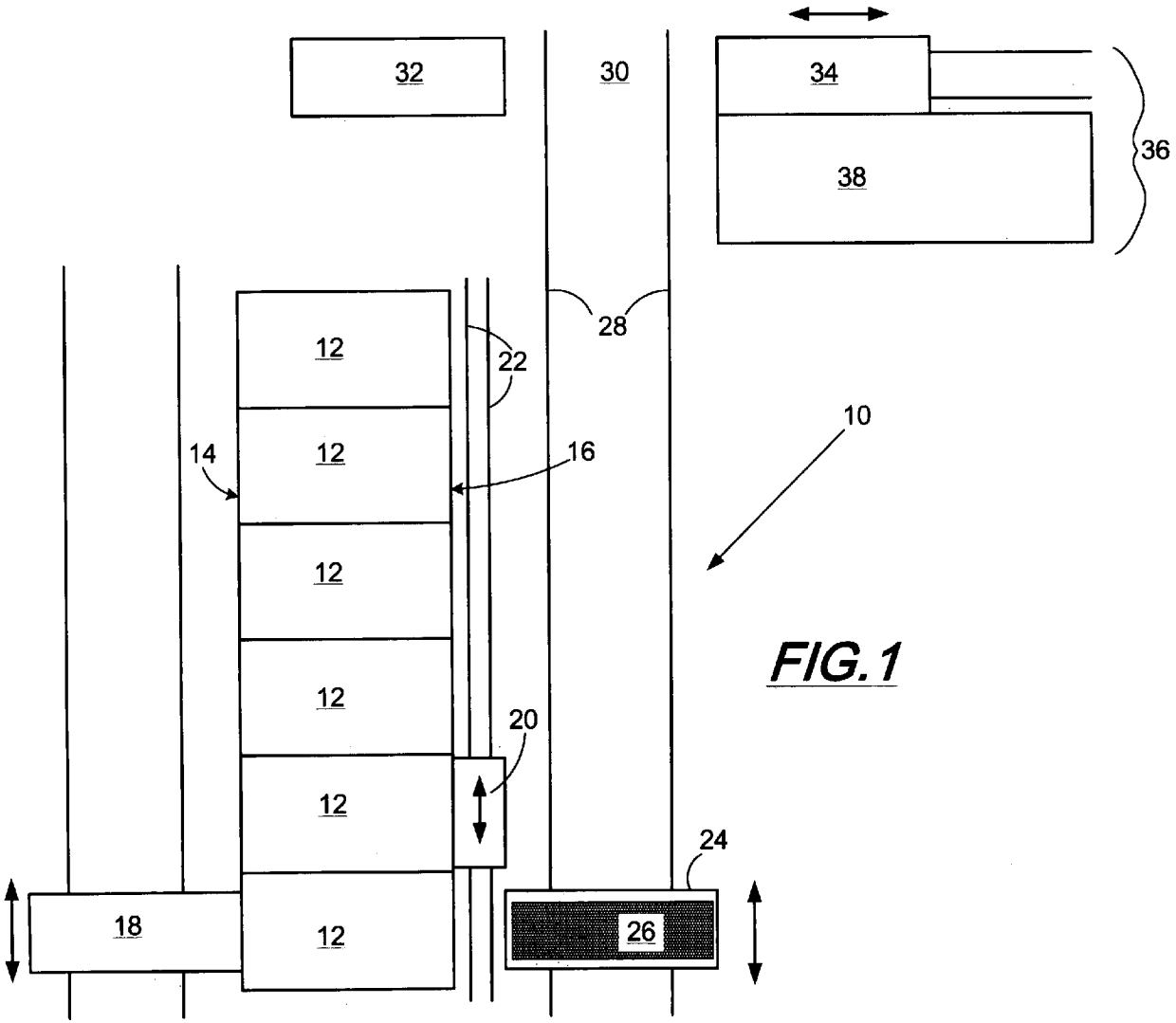
FIG. 1 is an overall plan view, not to scale, of a coke oven battery, quenching station, and associated equipment showing a hot car in a first position for receiving coke from a coke oven.
Figure 2:
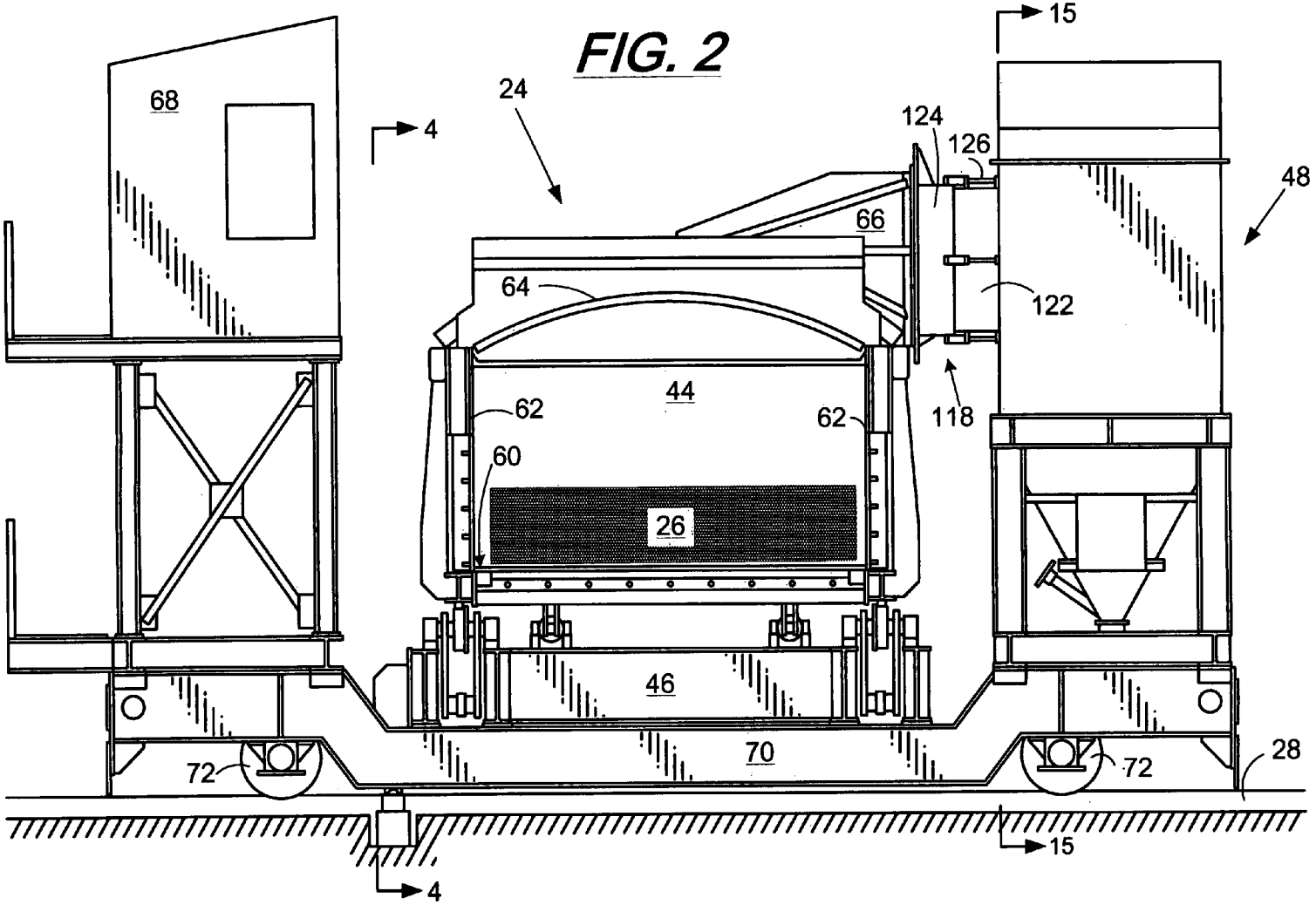
FIG. 2 is an elevational view, not to scale, of an end view of a hot car for receiving a coke slab from a coke oven.

With reference to FIG. 1, there is illustrated a plan schematic view of a coke oven battery 10 and associated equipment for removing and quenching coke produced in the coke oven battery 10 according to an exemplary embodiment of the disclosure. The typical coke oven battery 10 contains a plurality of side by side coke ovens 12. Each of the coke ovens 12 has a coal inlet end 14 and a coke outlet end 16 opposite the inlet end 14.

A typical coal coking cycle may range from 24 to 48 hours or more depending on the side of the coal charge to the coke oven 12. At the end of the coking cycle, the coke is pushed out of the oven 12 with a discharge ram 18 positioned adjacent the inlet end 14 of the oven 12. The discharge ram 18 may include a device for removing an inlet end 14 oven door prior to pushing the coke out of the oven 12.

A separate exit door removing device 20 is positioned adjacent the outlet end 16 of the oven 12 to remove an exit door of the oven 12. After removing the exit door, the door removing device 20 is moved away from the outlet end 16 of the oven 12 along door removal rails 22.

A flat push hot car 24 is positioned adjacent the outlet end 16 of the oven 12 for collection of hot coke pushed from the oven by the discharge ram 18. A detailed description of the flat push hot car 24, including mechanisms for positioning the flat push hot car 24 adjacent the outlet end 16 of the oven 12 is described in more detail below. During a hot coke push operation, the coke is pushed out of the oven 12 as a substantially unitary slab 26 that is loaded onto the flat push hot car 24.

Once the hot coke is loaded onto the hot push flat car 24, the car 24 is transported on rails 28 to a quench car area 30. In the quench car area 30, the hot coke slab 26 on the hot push flat car 24 is pushed by a stationary pusher 32 onto a quench car 34. The quench car 34 is positioned in a quench station 36 wherein the hot coke is quenched with sufficient water to cool the coke to below a coking temperature. The quenched coke is then dumped onto a receiving dock 38 for further cooling and transport to a coke storage area.

In conventional coke oven batteries, the hot coke is typically quenched in a hot car. Accordingly, there may be a need for one hot car for each coke battery. However, in the exemplary embodiments described herein, a single hot car 24 may be used for multiple coke batteries 10 since the coke is quenched in a separate quench car 34. As soon as the hot coke is pushed from the hot push flat car 24 onto the quench car 34, the hot push flat car 24 may be repositioned adjacent the outlet end 16 of another oven 12 for collection of coke from that oven 12.

As set forth above, the coke oven battery 10 includes the exit door removing device 20. The exit door removing device 20 is designed to provide operating personnel with a straightforward machine. The door removing device 20 includes mechanisms to traverse the device 20 along the oven battery on the rails 22, position the device 20 at the outlet end 16 of the oven 12 to be discharged, and remove the door 40 from that oven 12. The door removing device 20 than moves away from the oven 12 along the rails 22, carrying the oven door 40 to provide space for the flat push hot car 24 to be positioned adjacent the outlet end 16 of the oven 12 from which the door 40 was removed.

The exit door removing device 20 may be manually operated and thus may be equipped with an operator's cab or enclosure containing all control devices and motor control center cabinets, as well as an emergency stop. Typically, all operations performed by the door removing device 20 are hydraulically powered. For example, hydraulic cylinders are also used to unlock rotary locks 42 on the oven door 40 and to engage and retract the door 40 from oven 12. Prior to removing the door 40, a laser targeting device may be used by the operator to accurately position the device 20 adjacent the coke outlet end 16 of the oven 12. Mechanical interlocks may also be used to assure that the door removing device 20 is in the correct position to unlock and remove the door 40 from the oven 12. A diesel engine may be used to move the door removing device along the rails 22.

Figure 14:
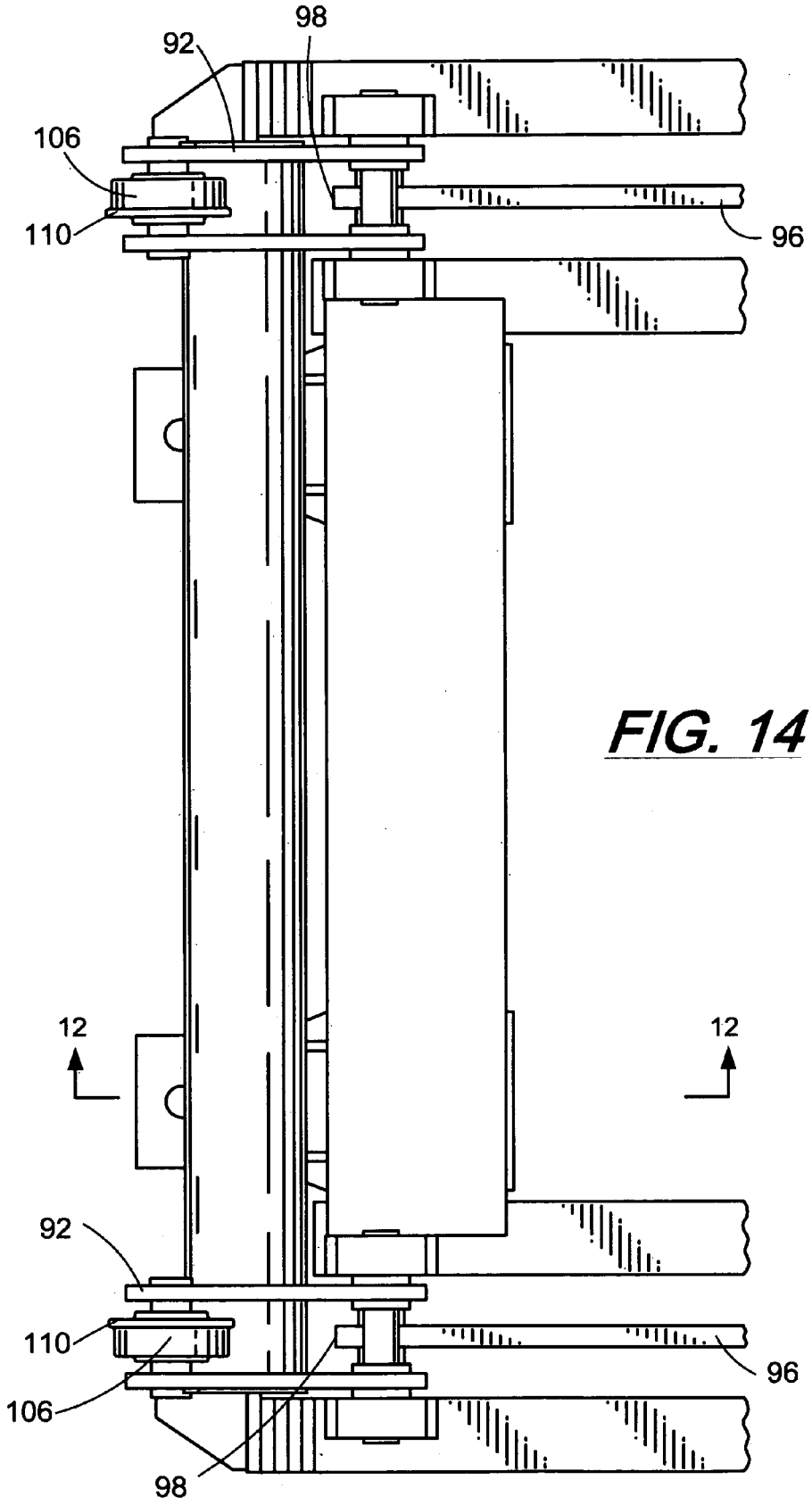
FIG. 14 is a top plan view, not to scale, of the lifting mechanism and actuator rollers of FIGS. 10-13.

With reference now to FIGS. 2-17, various aspects of the flat push hot car 24 will be illustrated and described. The flat push hot car 24 is a unique device that enables collection of a substantially unitary slab 26 of hot coke from the coke ovens 12 and transport of the hot coke slab 26 to the remote quench car area 30. As with the exit door removing device 20, the flat push hot car 24 is designed to traverse parallel to the coke oven battery 10 along the rails 28 between ovens 12 and the quench car area 30. The hot car 24 also contains a hot box 44, a hot box elevation and translation mechanism 46, a hot box dust collection system 48 (FIGS. 14-16), an oven skirt sweeping mechanism 50 (FIG. 9) and a lintel sealing device 52 (FIG. 8). Each of these mechanisms will be described in more detail below.

After the door removing device 20 has removed the coke outlet door 40 from an oven 12, the door removing device 20 is moved so that the flat push hot car 24 may be positioned in line with the oven 12 to receive the coke being pushed out of the oven 12 as shown in FIG. 1. A laser spotting device may be provided to assist an operator in visually aligning the flat push hot car 24 for proper interface with the oven 12. Once the hot car 24 has been properly spotted, one or more mechanical interlocks are activated to assure that the hot car 24 is in the proper position for receiving the coke slab 26.

Figure 3:
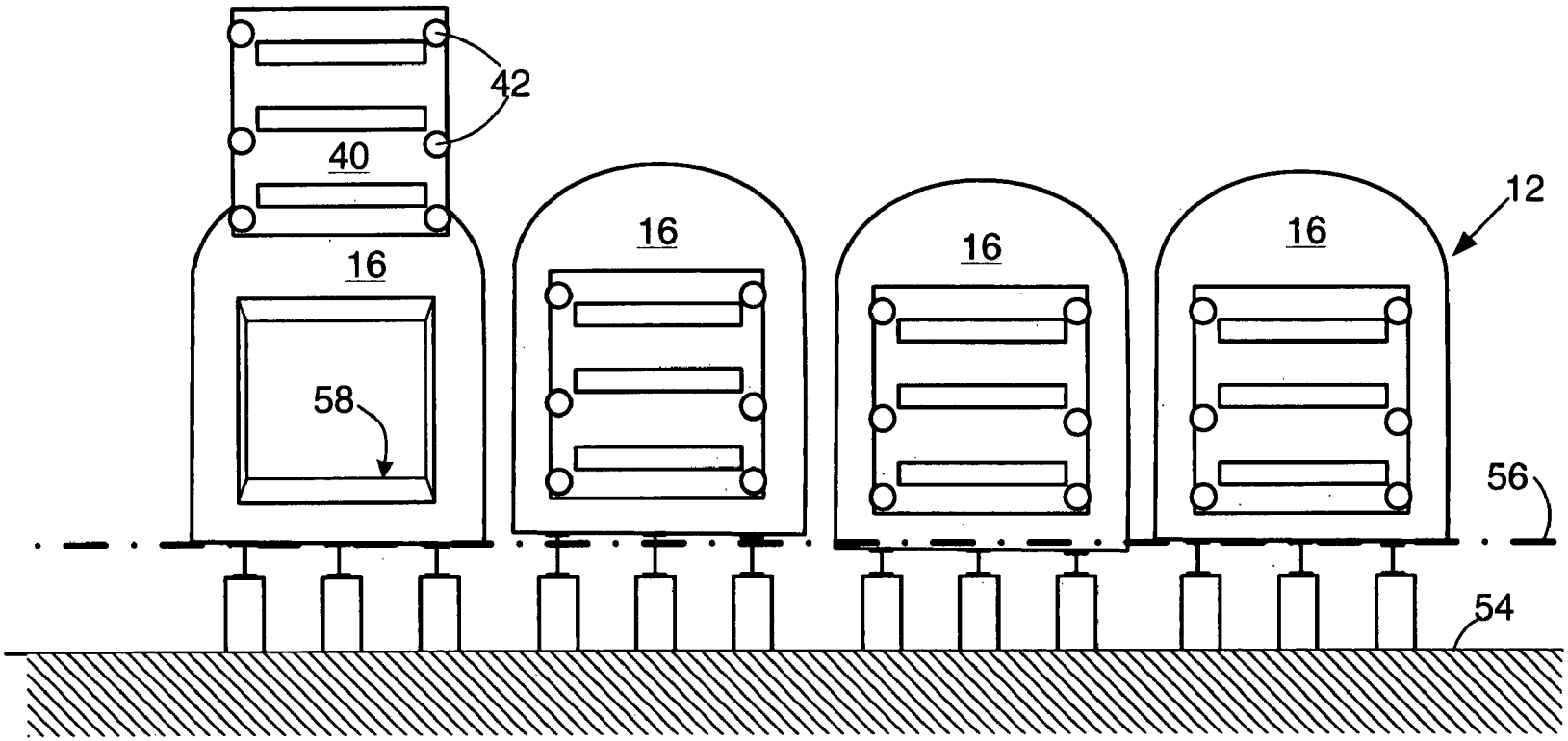
FIG. 3 is a coke discharge end view, not to scale, of a portion of the coke oven battery 10.

With reference now to FIG. 3, a portion of the coke oven battery 10 viewed from the coke outlet end 16 of the ovens 12 is illustrated. As will be appreciated, each of the ovens 12 may be at slightly different heights above a ground elevation 54 as indicated by reference line 56. Accordingly, the flat push hot car 24 must be adjusted to the height of each oven 12 during the coke pushing operation in order to push a substantially unitary slab 26 of hot coke onto the hot car 24.

As shown in FIG. 1, the exit door removing device 20 moves parallel to the coke oven battery 10 between the coke oven battery 10 and the hot car 24. Accordingly, a mechanism is provided on the hot car 24 to position the hot box 44 adjacent the outlet end 16 of the oven 12 and for providing a relatively smooth transition for the hot slab 26 of coke to move from the oven floor 58 to the hot box 44.

With reference again to FIG. 2, an end elevational view of the flat push hot car 24 is illustrated. The hot car 24 includes the hot box 44 movably disposed on the elevation and translation mechanism 46. The hot box 44 is a substantially rectangular housing having a floor portion 60, side walls 62 attached to the floor portion 60 and a cover 64 attached to the side walls 62. Each end of the hot box 44 is open for receiving a hot coke slab 26 and pushing the hot coke slab 26 onto the quench car 34.

The dust collection system 48 is provided in flow communication with the hot box 44 via a collection duct 66 to collect any dust or fumes that may be evolved from the coke during the coke pushing operations. An operator housing 68 is provided on the flat push hot car 24 for an operator to control positioning and use of the hot car 24 and operation of the dust collection system 48. All of the foregoing components of the hot car 24 are mounted on a frame 70 that contains wheels 72 for movement of the hot car on the rails 28.

Figure 4:
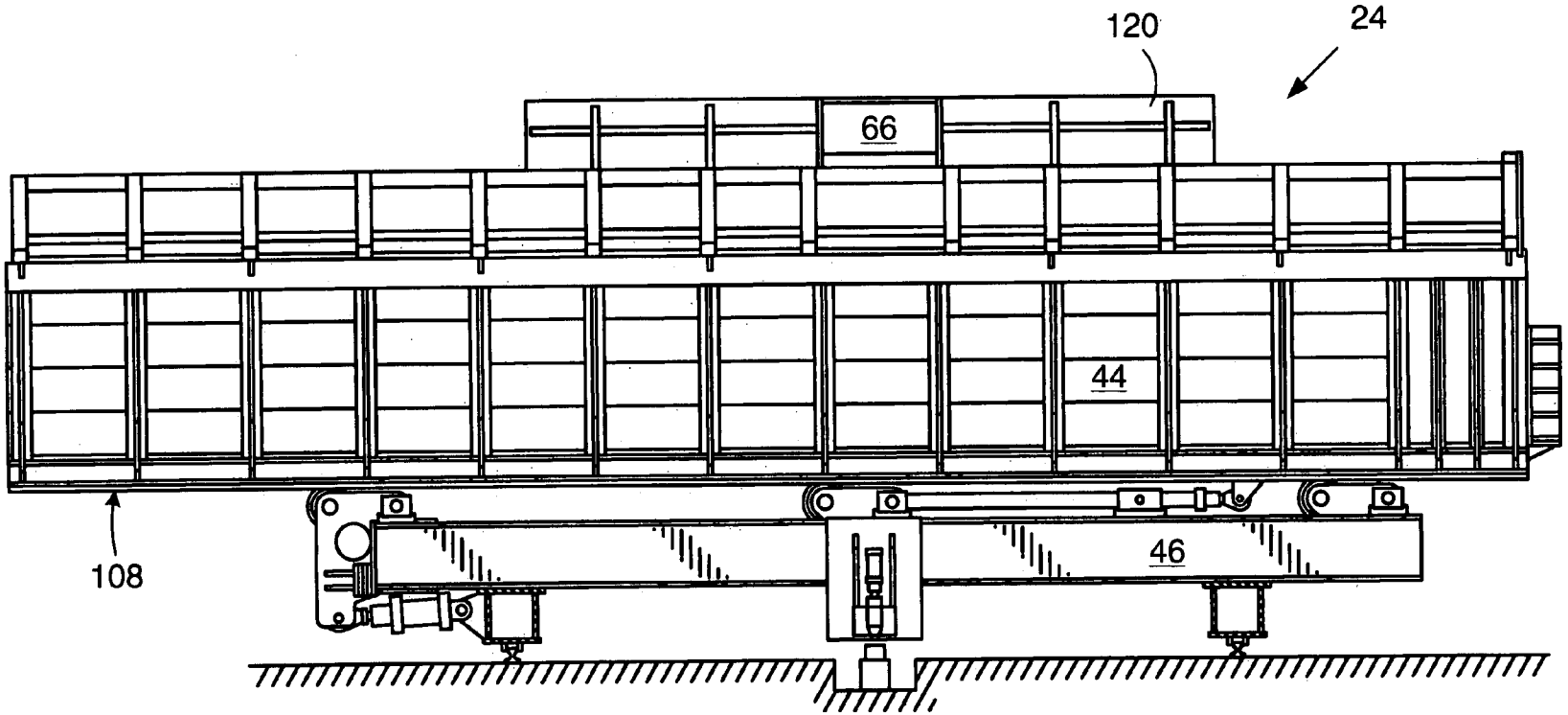
FIG. 4 is an elevational side view, not to scale, of a hot car in a lowered position according to an embodiment of the disclosure.
Figure 5:
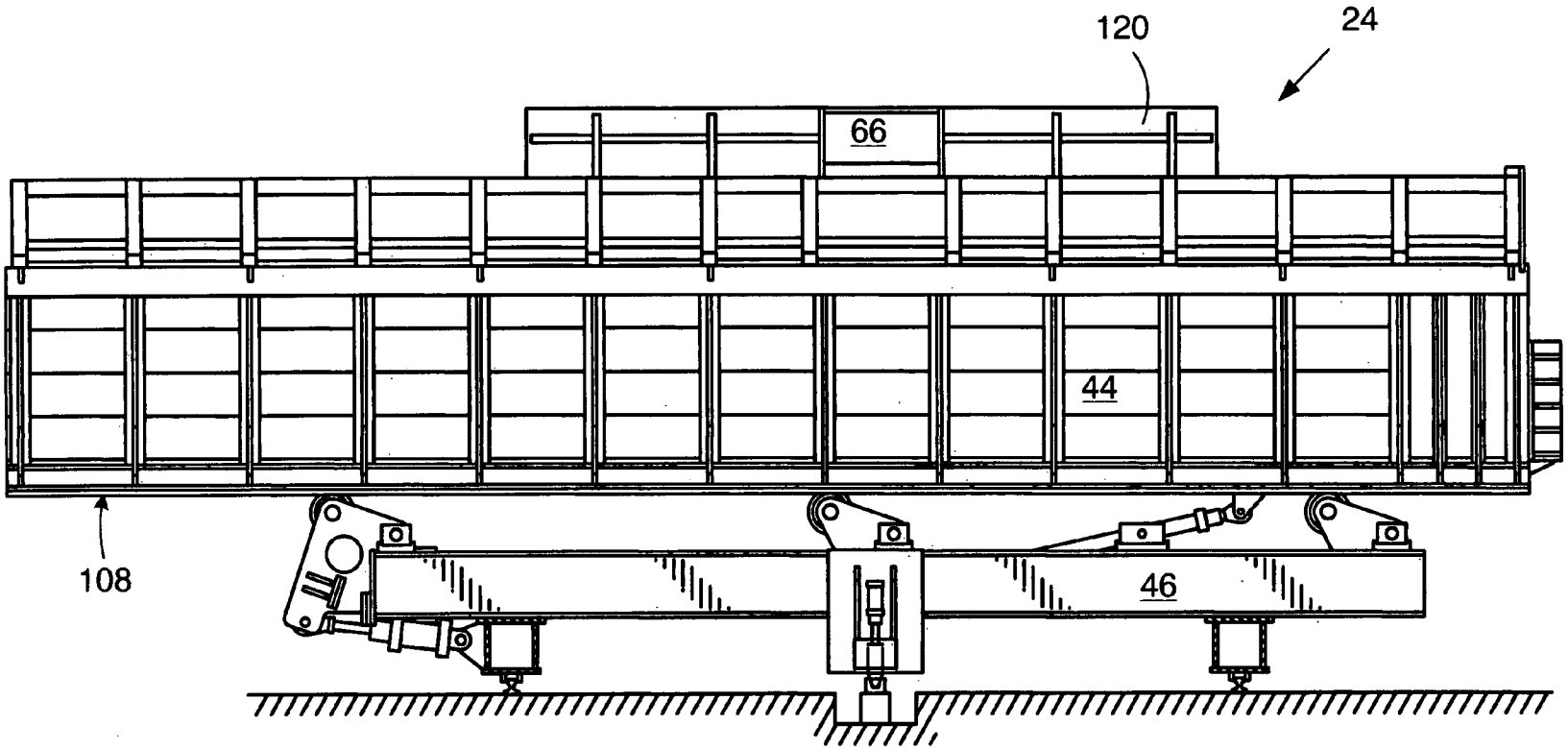
FIG. 5 is an elevational side view, not to scale, of a hot car in a raised position according to an embodiment of the disclosure.

FIG. 4 illustrates a first elevational position of the hot box 44 relative to the frame 70. The first elevational position is used for moving the hot car 24 along the rails 28. In the first elevational position, the hot box 44 is closely adjacent the frame 70. Upon positioning the hot car 24 adjacent an oven 12, the hot box 44 is raised to a second elevational position as shown in FIG. 5. In the second elevational position, the hot box 44 is substantially at the same height as the oven floor 58.

Figure 6:
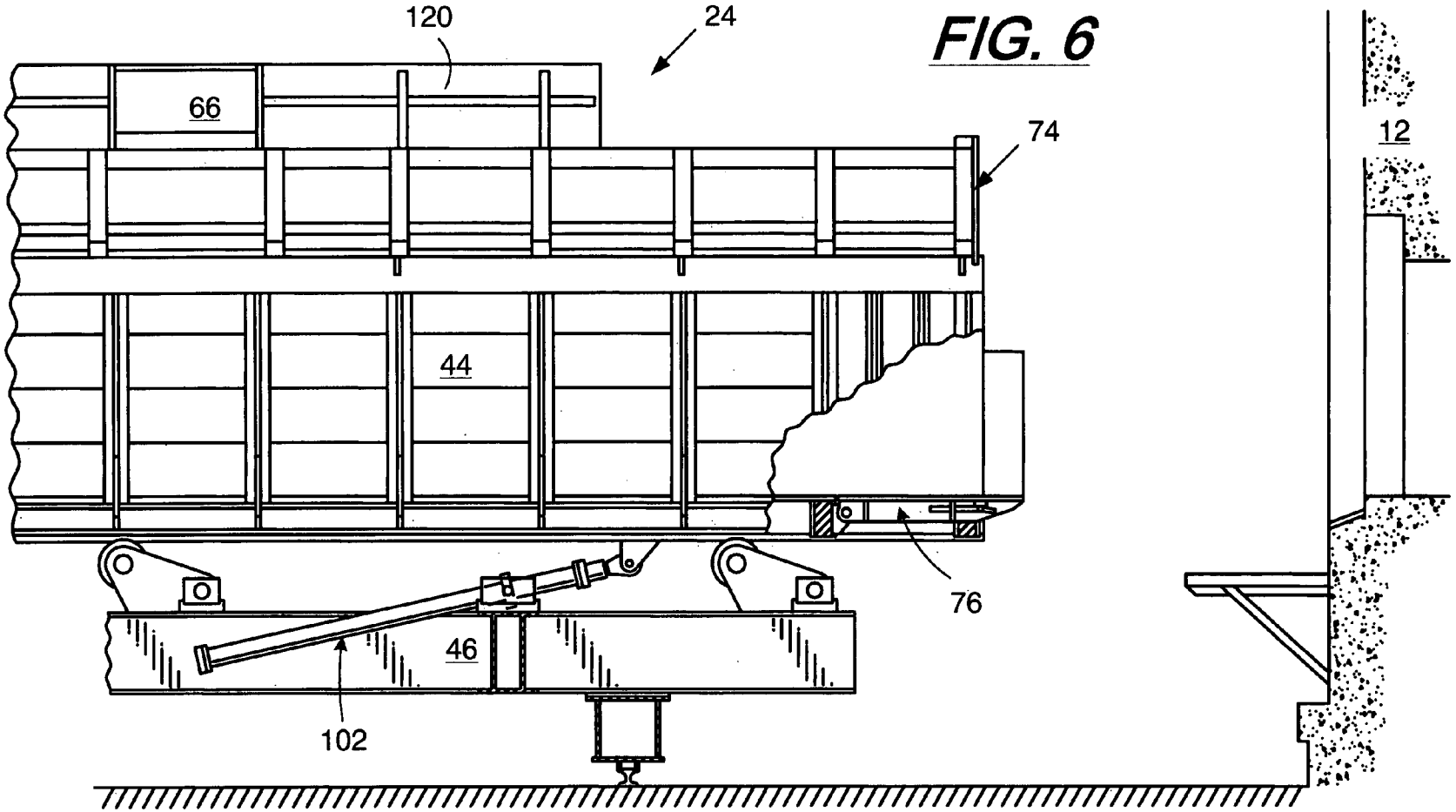
FIG. 6 is an elevational side view, not to scale, of a hot car in a first translational position for movement toward a coke oven.
Figure 7:
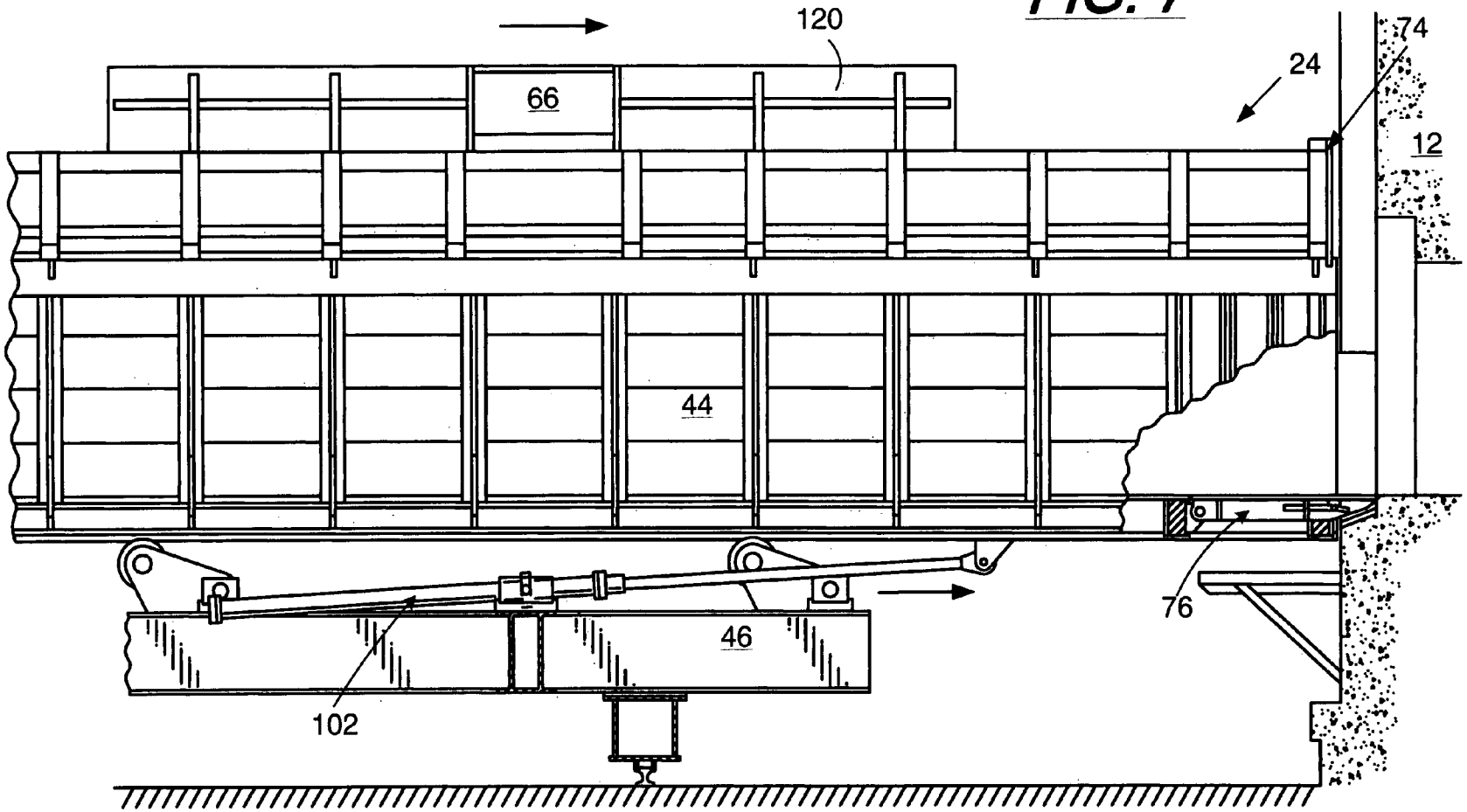
FIG. 7 is an elevational side view, not to scale, of a hot car in a second translational position adjacent the coke oven.
Figure 8:
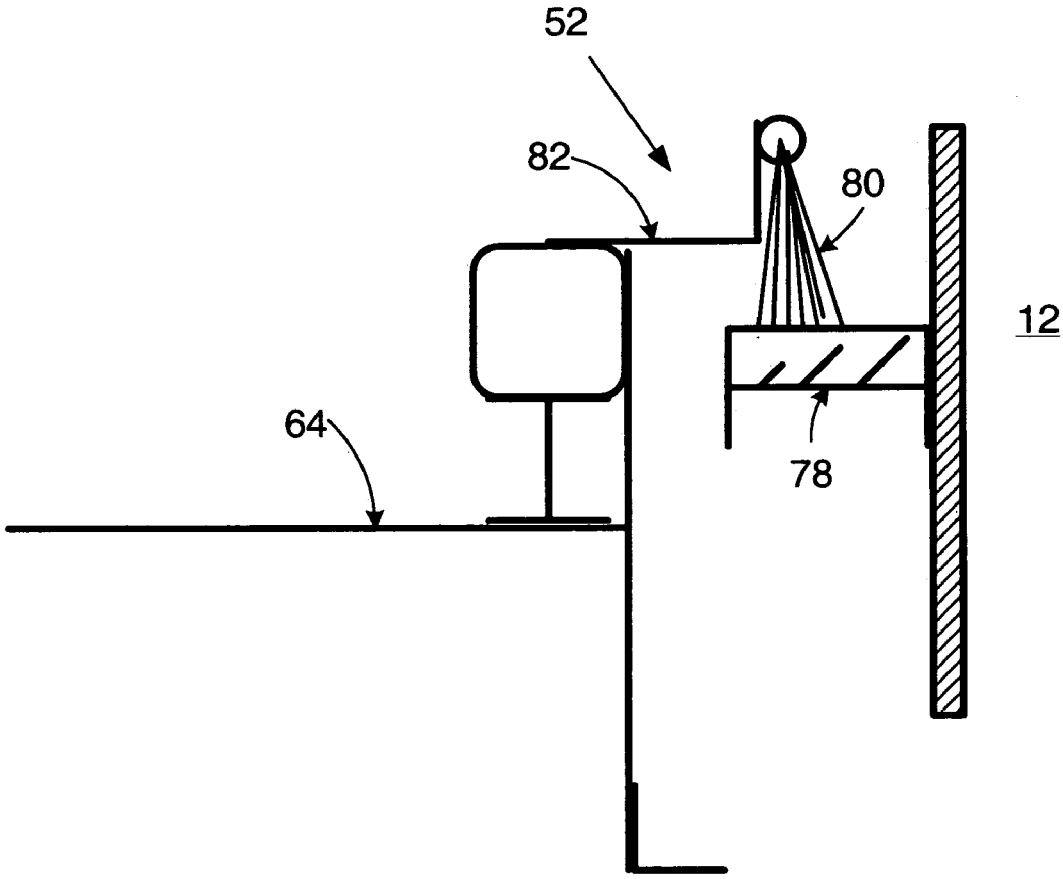
FIG. 8 is an elevation side view, not to scale, of a lintel sealing device attached to a hot car.

Once the hot box 44 is an elevation suitable, illustrated in FIG. 6, for transfer of the substantially unitary slab 26 of coke from the oven 12, the operator traverses the hot box 44 forward until an end 74 of the hot box 44 is closely adjacent to the oven 12, as shown in FIG. 7, to provide a substantially continuous surface for pushing the coke from the oven into the hot box 44. A transition section 76 may be pivotally attached adjacent the end 74 of the hot box 44 to prevent the hot box 44 from damaging the oven floor 58 upon mating the hot box 44 with the oven 12.

The lintel sealing device 52 is shown in more detail in FIG. 8 and engages a lintel beam 78 of the oven 12 when the end 74 of the hot box 44 is closely adjacent to the oven 12. The lintel sealing device 52 provides sealing between the hot box 44 and the oven 12 in order to reduce an amount of dust that may escape from the open end 16 of the oven 12. The lintel sealing device 52 includes a flexible wire brush-like member 80 fixedly attached to an extension arm 82 on the cover 64 of the hot box 44 for sealing contact with a lintel beam 78 of the oven 12 as the hot box 44 is traversed toward the oven 12.

Once the coke slab 26 has been pushed into the hot box 26 by the coke discharge ram 18, the operator retracts the hot box 44 away from the oven 12 and lowers the hot box 44 to the first elevational position illustrated in FIG. 4.

Figure 9:
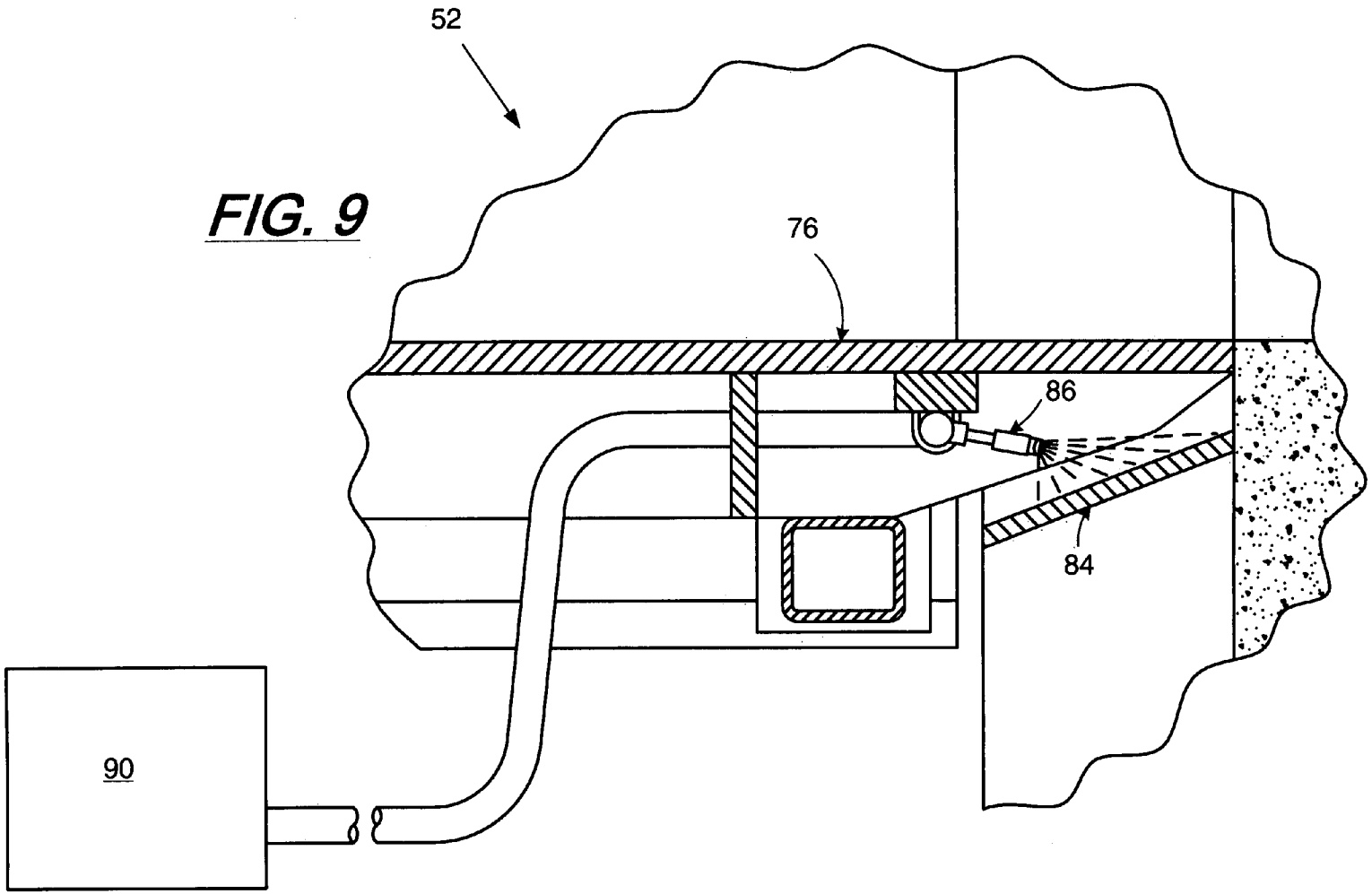
FIG. 9 is a schematic view of a oven sill sweeping device attached to a hot car.

In order to prevent accumulation of coke dust on an oven sill 84 attached to each oven 12 after removing the oven exit door 40 or after pushing the coke slab 26 onto the hot car 24, the oven skirt sweeping mechanism 50, as shown in FIG. 9, may be provided on the transition section 76. In one embodiment, the sweeping mechanism 50 may include a gas jet spray nozzle 86 and a source 88 of compressed gas in fluid flow communication with the spray nozzle 86. The spray nozzle 86 may be activated by the operator when the oven door 40 is removed to provide a relatively coke free sill 84 for mating with the transition section 76 of the hot box 44 and/or after pushing the coke onto the hot car 24 before replacing the oven exit door 40.

Figure 10:
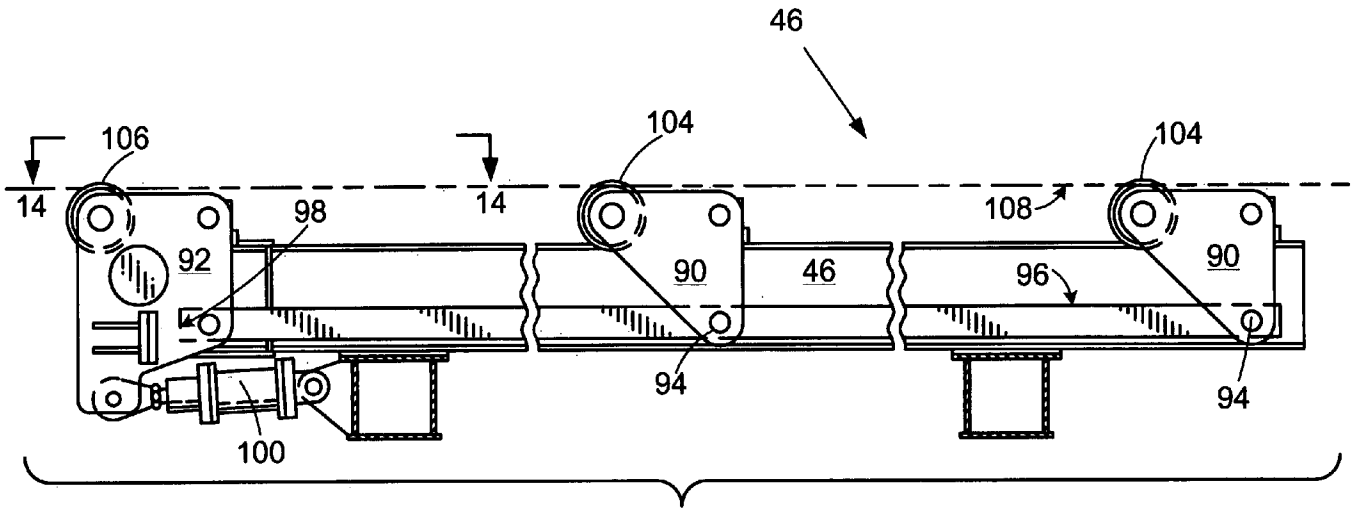
FIGS. 10 and 11 are elevational side views, not to scale, of a lifting mechanism for a hot car.
Figure 11:
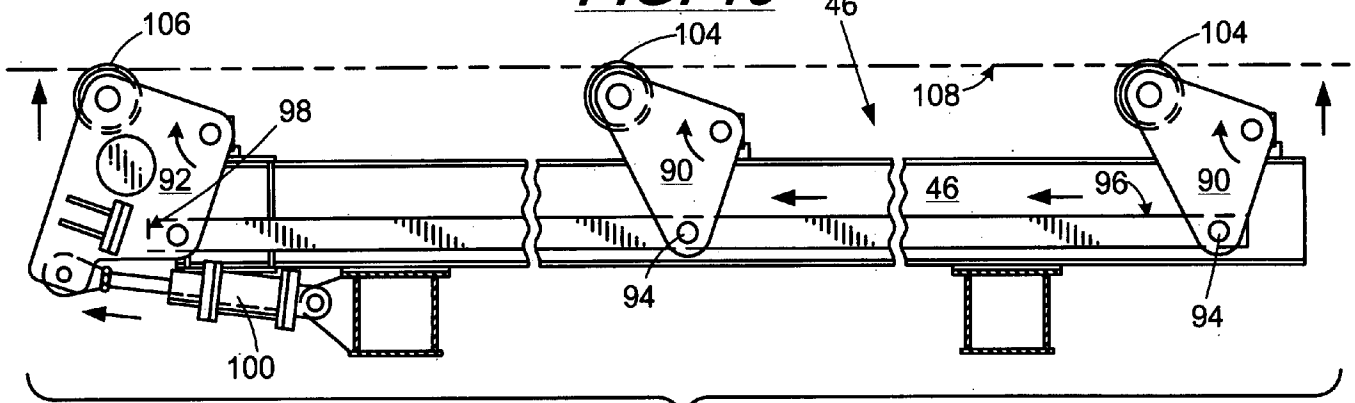
Figure 12:
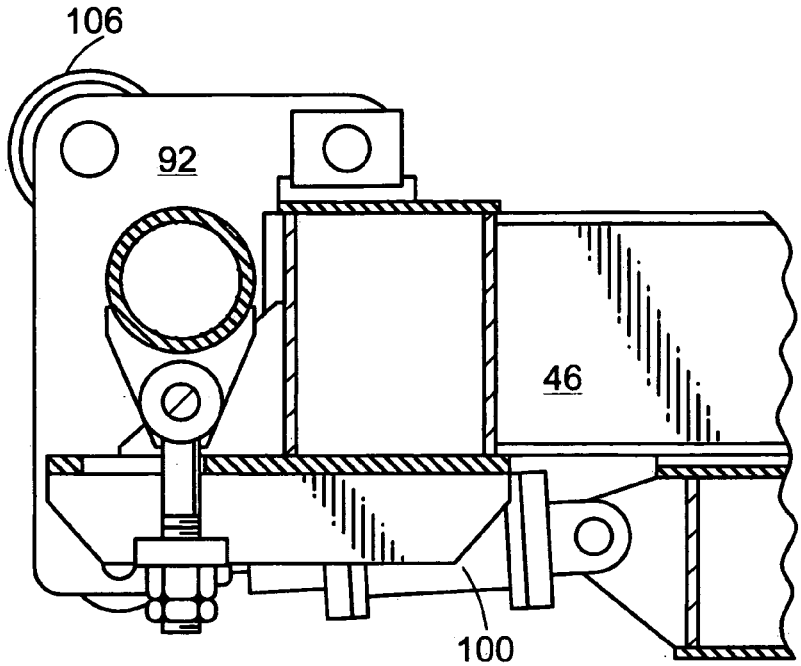
FIGS. 12 and 13 are elevational side views, not to scale, of actuator rollers for a lifting mechanism for a hot car.
Figure 13:
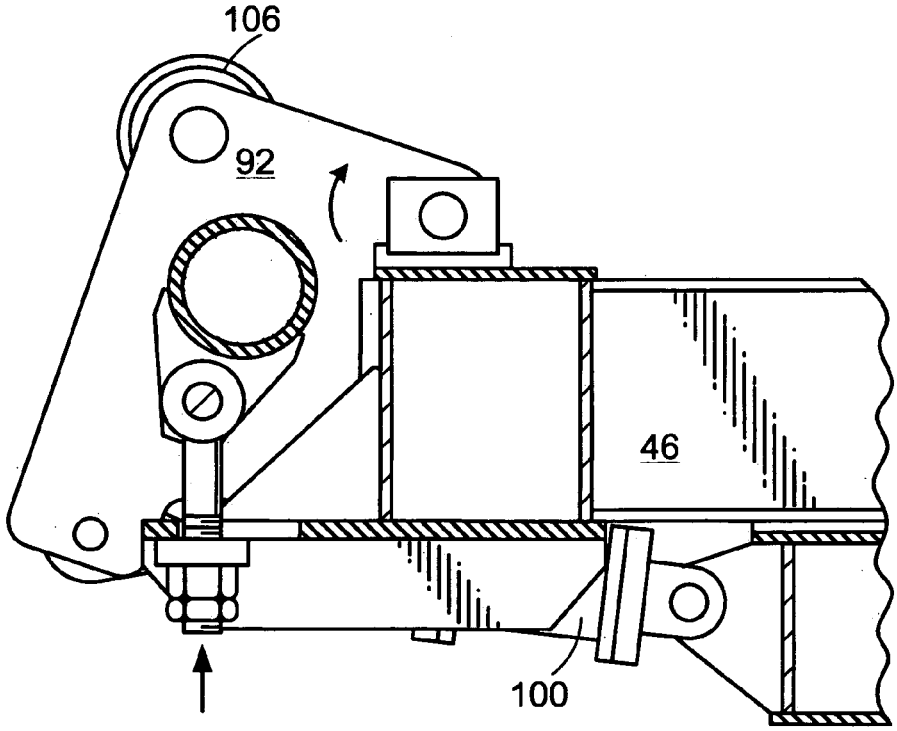

Details of portions of the elevation and translation mechanism 46 for elevating and translating the hot box 38 are provided in FIGS. 10-14. FIGS. 10 and 11 illustrate a portion of the elevation and translation mechanism 46 containing pivoting rollers 90 and an actuator roller 92. Each pivoting roller 90 is attached to the frame 70 about a pivot pin 94 and each roller 90 is pivotally linked to an actuator arm 96 for rotating the pivoting rollers 90 from a first position illustrated in FIG. 10 to a second position illustrated in FIG. 11. The actuator arm 96 is pivotally connected on a distal end 98 to the actuator roller 92 so that movement of the actuator roller 92 causes movement of the pivoting rollers 90. A actuator mechanism 100 is attached to the frame 70 and to the actuator roller 92 to cause movement of the actuator roller 92 and the pivoting rollers 90 in order to raise and lower the hot box 44. The actuator mechanism 100 may be selected from a wide variety of mechanisms such as worm gears, chain drives, hydraulic cylinders, and the like. A hydraulic cylinder actuator mechanism 100 is particularly suitable for use in the elevation and translation mechanism 46 described herein.

As set forth above, due to oven height disparities, the elevation and translation mechanism 46 may be used to provide the hot box 44 at a desired elevation for pushing the substantially unitary slab 26 of coke onto the hot car 24. Variations in oven height typically range from about one to about five inches. Accordingly, the elevation and translation mechanism 46 should be capable of moving the hot box 44 up or down from one inch to five inches and holding the hot box 44 at a desired elevation between one inch and five inches. It will be appreciated that height elevations that may be needed for a particular oven battery may range more than from about one to about five inches.

Referring again to FIGS. 6 and 7, once the hot box 44 is at the desired elevation, a translation actuator 102 attached to the frame 70 and to the hot box 44 may be used to translate the hot box 44 from a retracted position, shown in FIG. 6, to a coke pushing position, shown in FIG. 7. In the retracted position, there is a space between the oven 12 and the hot box 44 sufficient for movement of the exit door removing device 20 therebetween. However, in the coke pushing position illustrated in FIG. 7, the end 74 of the hot box is closely adjacent to the oven 12 and the transition section 76 is resting on the oven sill 84. After loading the coke onto the hot car 24, the hot box 44 is retracted from the oven 12 and lowered to the first elevational position for transport to the quench area 30. The exit door removing device 20 may then be moved back into position adjacent the oven 12 to replace the exit door 40 on the oven 12.

In order for the hot box 44 to be moved between the coke pushing position and the retracted position, each of the pivoting rollers 90 and the actuator roller 92 contains wheels 104 and 106, respectively that enable a translational movement of the hot box 44 thereon relative to the frame 70. The wheels 104 and 106 engage a bottom side 108 of the hot box 44 or rails attached to the bottom side 108 of the hot box for rolling movement thereon. In the case of rails attached to the bottom side 108 of the hot box 44, the wheels 104 and 106 may include shoulders 110 (FIG. 14) which engage edges of the rails to provide movement of the hot box 44 along substantially a single axis of movement.

Figure 15:
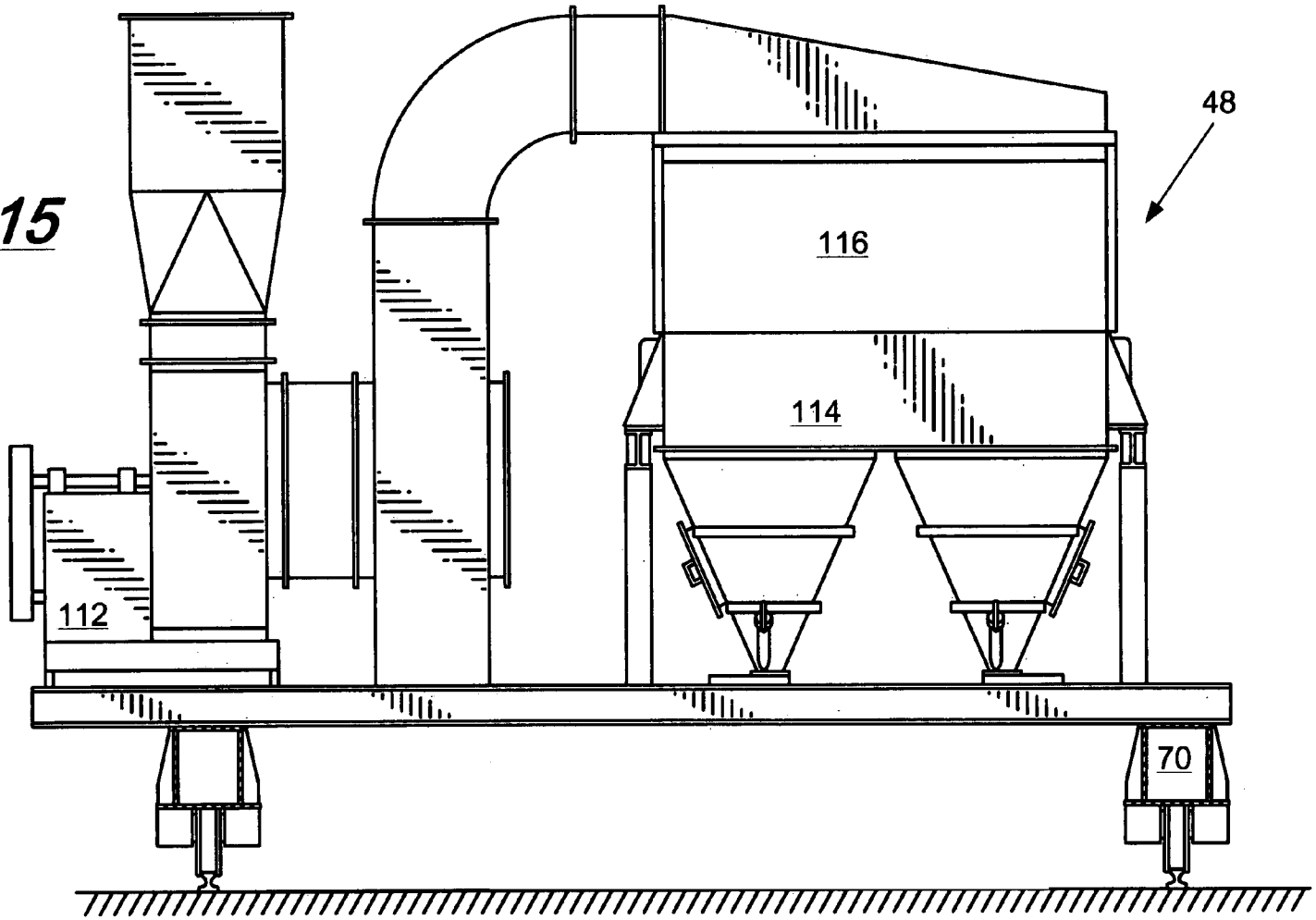
FIG. 15 is an elevational view, not to scale, of a dust collection system attached to a hot car according to an embodiment of the disclosure.
Figure 16:
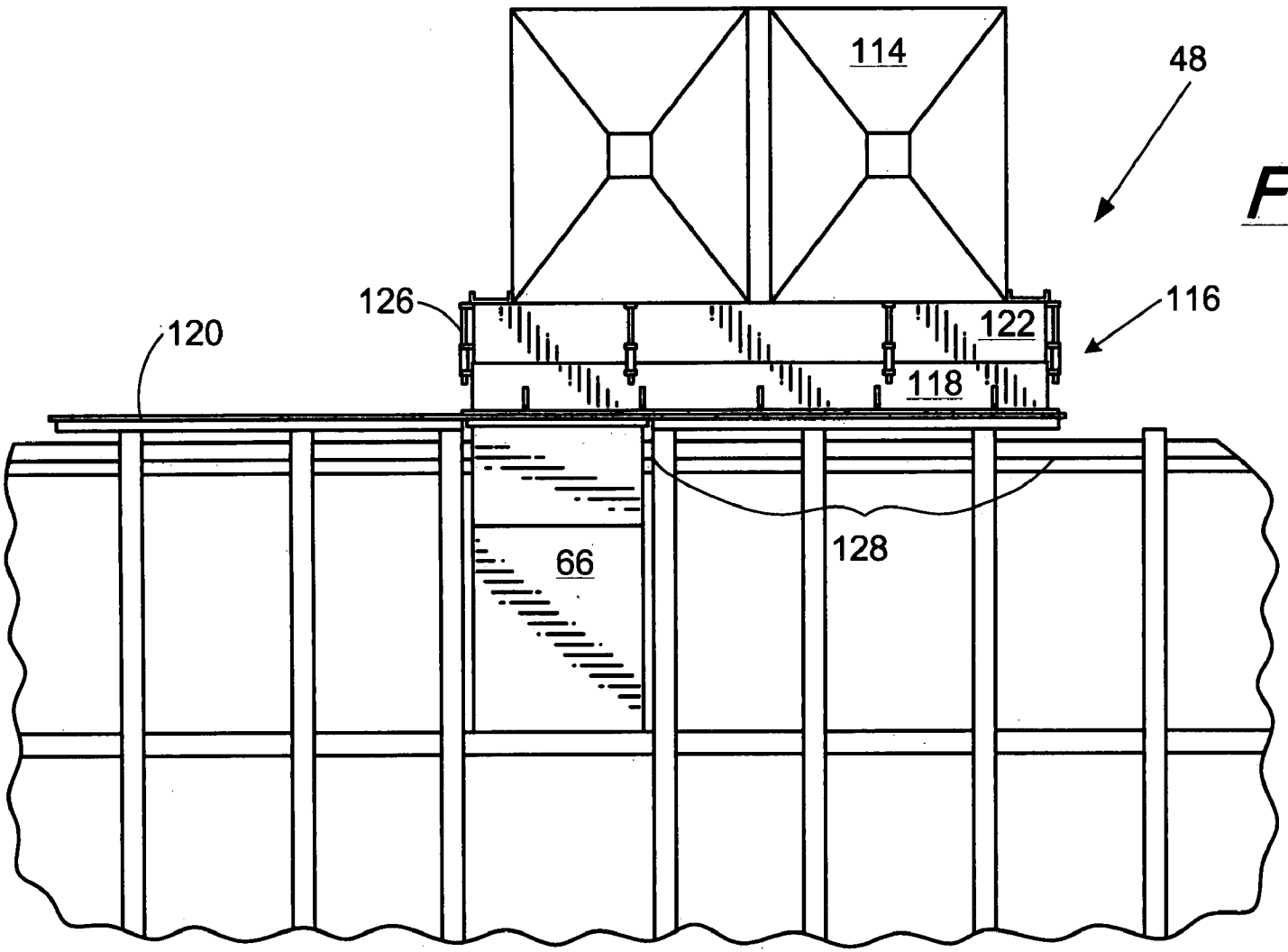
FIGS. 16 and 17 are top plan views, not to scale, of the dust collection system of FIG. 15 when a hot box on a hot car is in first and second positions.
Figure 17:
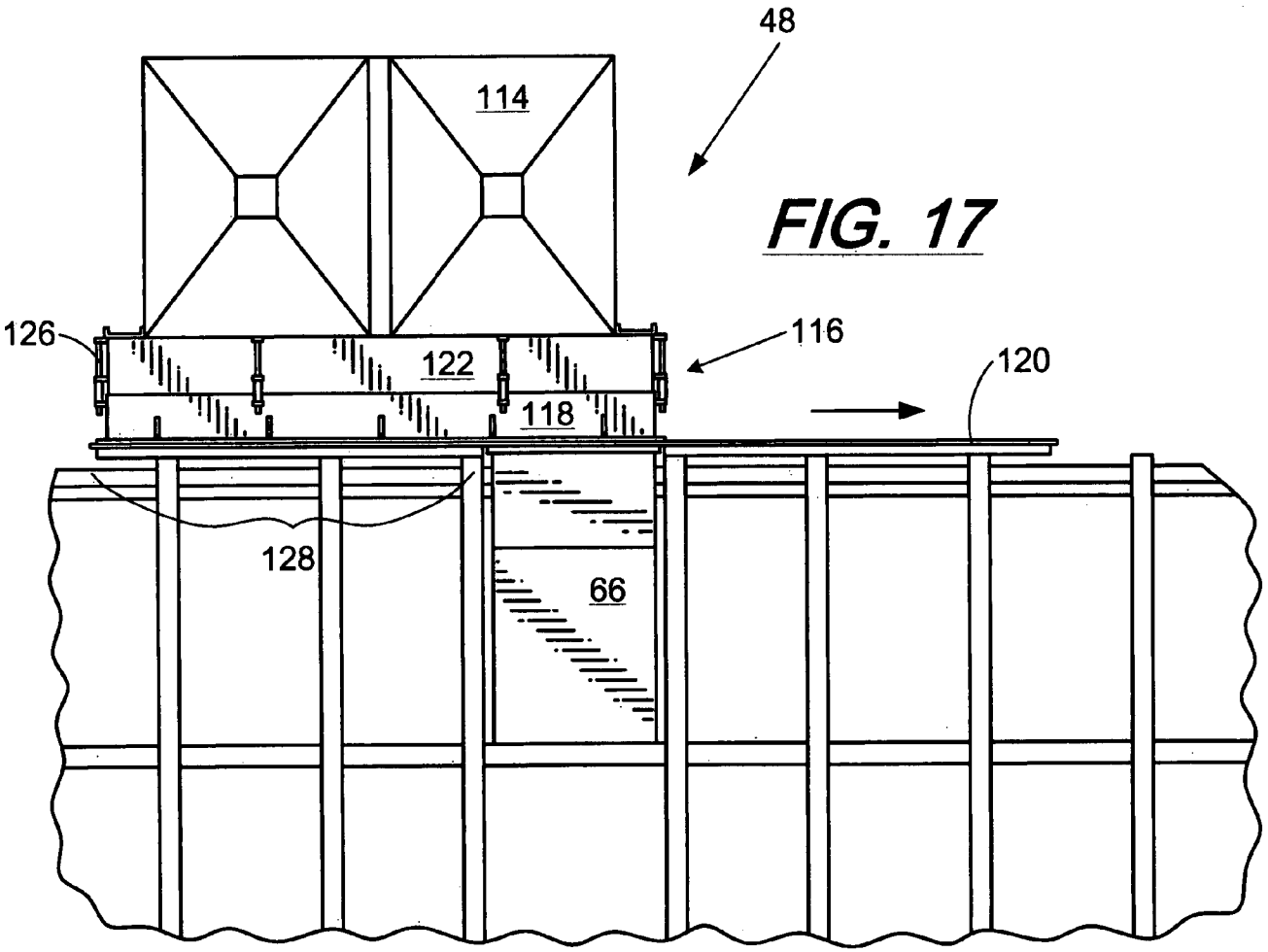

Another unique aspect of the hot car 24 is the integral dust collection system 48 illustrated in more detail in FIGS. 15-17. The dust collection system 48 includes a blower 112 for providing a flow of air, fumes, and dust from the hot box 44 though a dust collection multi-clone 114. Flame arrestors may be used in a biased sliding duct 118 (FIG. 2) connecting the collection duct 66 to the multi-clone 114 in case glowing dust particles are entrained in the air stream flowing to a dust collection. Other suitable dust collection systems 48 that may be used may be selected from bag houses, multi-clones, wet scrubbers, electrostatic precipitators, and the like.

The dust collection system 48 is fixedly attached to the frame 70 adjacent one side of the hot box 44. Accordingly, as the hot box 44 moves longitudinally from the retracted position (FIG. 6) to the coke pushing position FIG. 7, a continuous flow of air, fumes, and dust must be maintained between the collection duct 66 and the multi-clone 114.

In order to maintain a seal between the multi-clone 114 and the collection duct 66 on the hot box 44, the biased sliding connecting duct 118 is disposed to slide along and a baffle plate 120 that is fixedly attached to the duct 66 exiting the hot box 44. The biased sliding duct 118 includes a fixed portion 122 and a movable portion 124 that is attached to the fixed portion 122 and is biased away from the multi-clone 114 toward the baffle plate 120 for sliding movement longitudinally along the baffle plate 120. Biasing devices such as springs 126 (FIG. 2) bias the movable portion 124 of the duct 118 against the baffle plate 120 to maintain a gas seal between the sliding duct 118 and the baffle plate 120.

As the hot box 44 moves from the first position illustrated in FIG. 16 to the second position illustrated in FIG. 17, the sliding duct 118 slides along the baffle plate 120 to maintain a continuous fluid flow connection between the duct 66 and the multi-clone 114. Since the sliding duct 118 is substantially wider than the duct 66, the baffle plate 120 is effective to seal a first portion 128 of the duct 118 when the hot box 44 is in the first position and a second portion 120 of the duct 118 when the hot box 44 is in the second position.

During the positioning of the hot box 44 to receive the coke slab 26, the dust collection system 48 is operated to collect any fumes, dust, etc., generated when the hot box 44 is adjacent to the oven 12. The dust collection system 48 may continue to operate until the coke slab 26 has been pushed from the hot car 24 onto the quench car 34.

Figure 18:
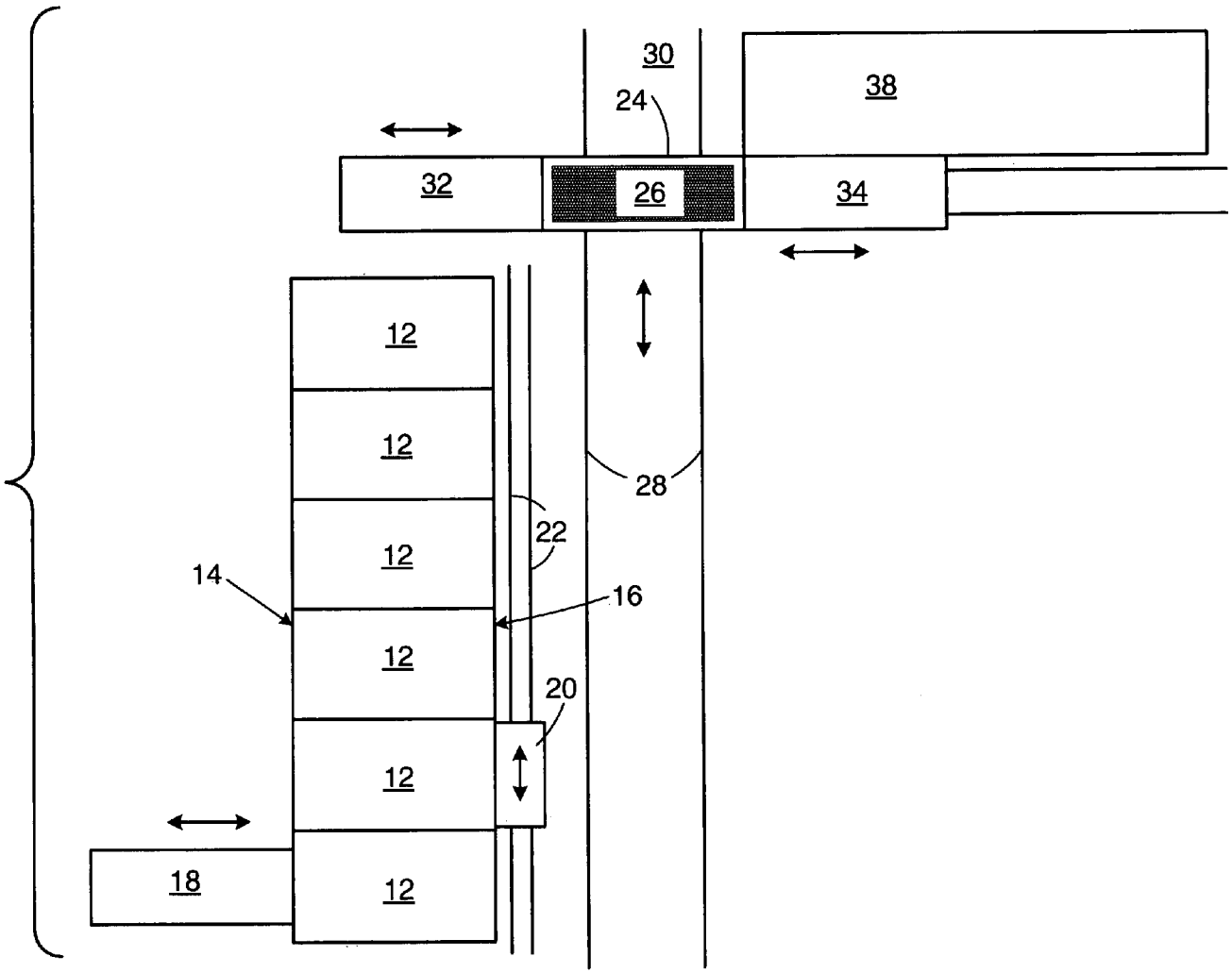
FIG. 18 is an overall plan view, not to scale, of a coke oven battery, quenching station, and associated equipment showing a hot car in a second position for discharging coke onto a quench car.

Once the coke slab has been pushed onto the hot car 24, the exit door 40 of the oven 12 is reinstalled on the exit side 16 of the oven 12 by the exit door removing device 20 and the hot car 24 is transported on the rails 28 to the quench area 30 as shown schematically in FIG. 18. In the quench car area 30, the hot slab of coke 26 is pushed using the stationary pusher 32 onto the quench car 34.

Details of the stationary pusher 32 are provided in FIGS. 19-28. The pusher 32 includes a fluid cooled ram head 132 attached to a gear driven extension arm 134 having a first arm section 136 and a second arm section 138. A cooling fluid spray nozzle 140 is provided adjacent the fluid cooled ram head 132. A guiding track 142 guides movement of the second arm section 138 from a first position illustrated in FIG. 19 to a second position illustrate in FIG. 28.

Figures 19, 20:
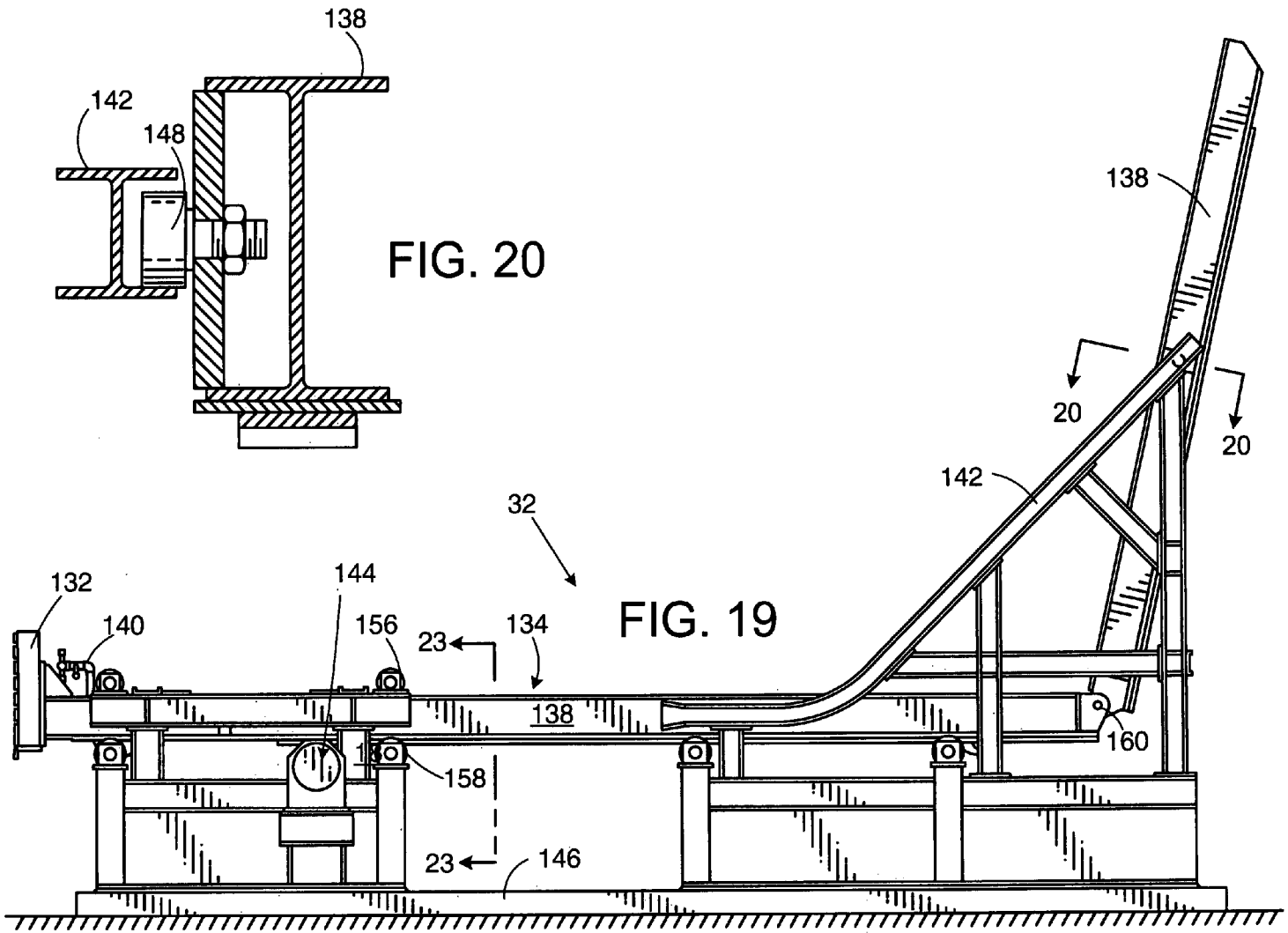
FIG. 19 is a side elevational view, not to scale, of a stationary pusher for pushing a coke slab from a hot car onto a quench car.
FIG. 20 is a detail view, not to scale, of a guide and roller for a second extension arm section of a pusher.
Figure 21:
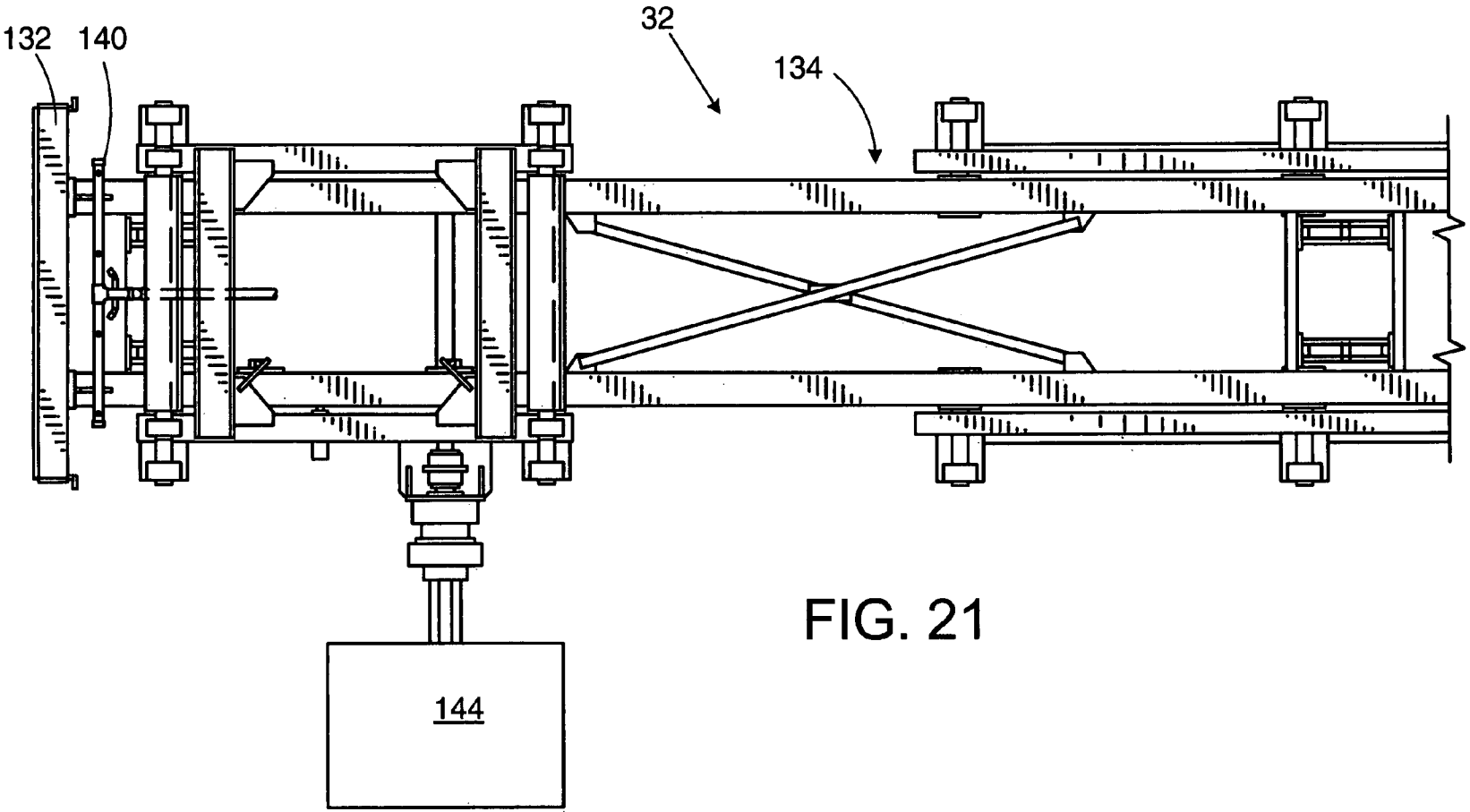
FIG. 21 is a top plan view, not to scale, of the stationary pusher of FIG. 19.
Figure 22:
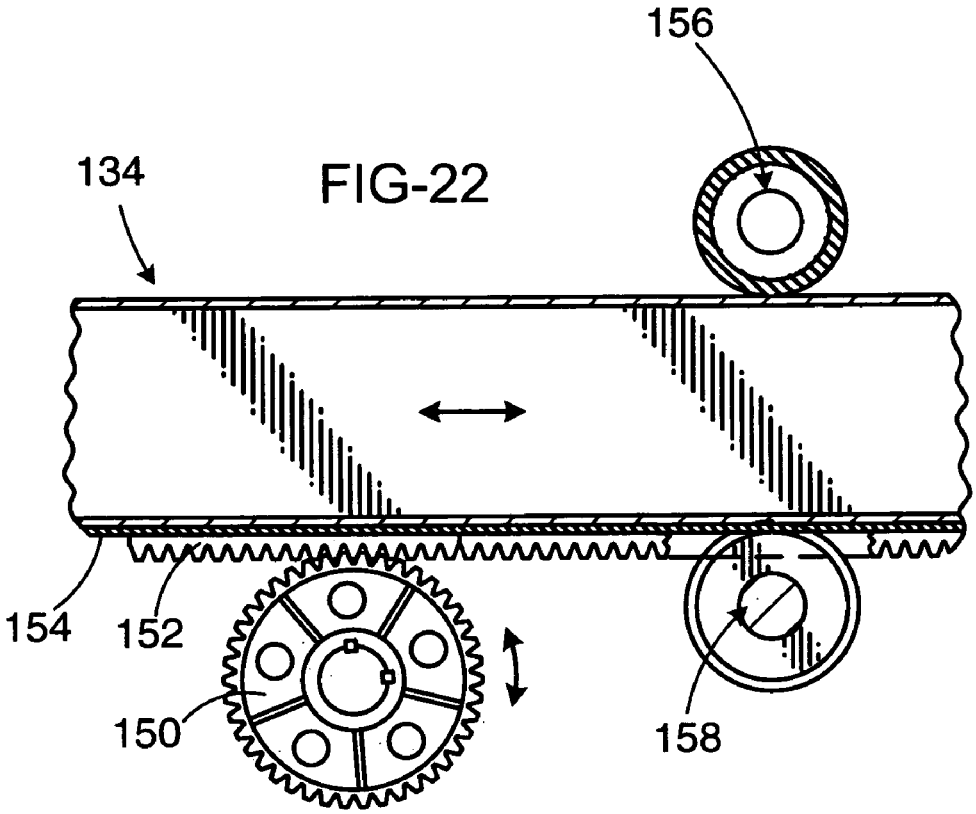
FIG. 22 is a detailed view, not to scale, of a gear mechanism for extending a stationary pusher arm.
Figure 23:
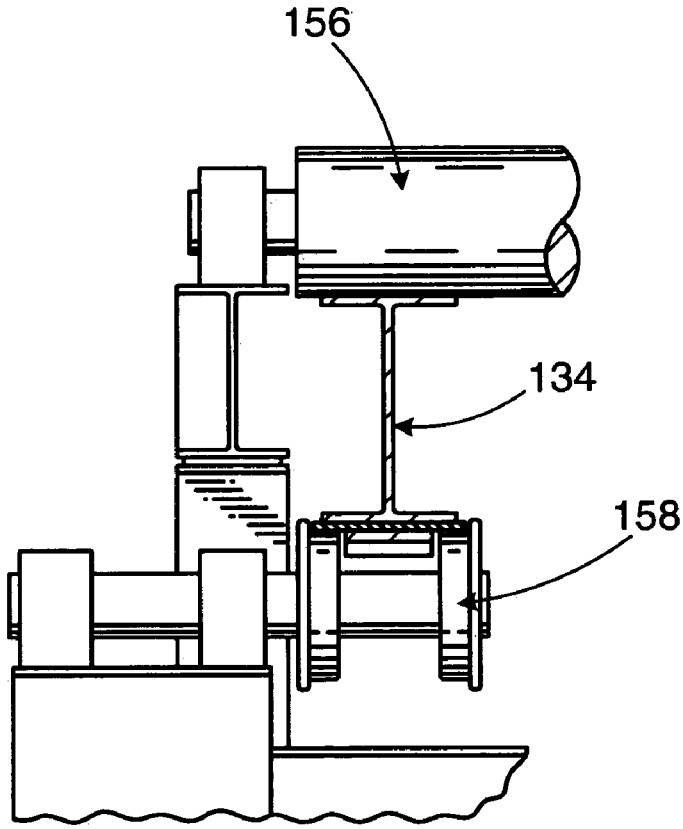
FIG. 23 is a detailed view, not to scale, of guiding rollers for a pusher arm of the stationary pusher of FIG. 19.

A gear drive mechanism 144 provides movement of the extension arm 134 between the first position and the second position. The gear drive mechanism 144 is operatively attached to a ram frame 146 and may be an electric motor or preferably a hydraulic gear drive mechanism 144 (FIG. 19). A guide member 148 is rotatably attached to the second arm section 138 (FIG. 20) to guide the second arm section 138 along the guiding track 142 as the gear drive mechanism 144 is operated to move the extension arm 134. As shown in FIG. 22, the gear drive mechanism 144 contains a gear 150 that engages gear teeth 152 disposed on a lower edge 154 of the extension arm 134. Guiding rollers 156 and 158 (FIGS. 22-23) are provided on opposing sides of the extension arm 134 to maintain the extension arm 134 in engaging contact with the gear 150.

Figure 24:
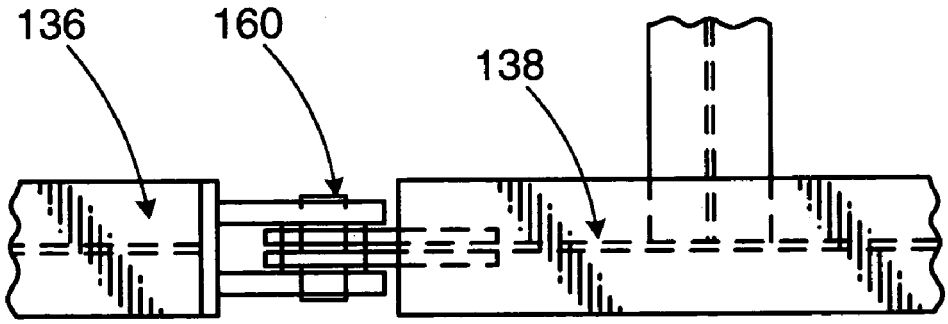
FIGS. 24-25 are detailed views, not to scale, of pivotal connections between first and second arm sections of the stationary pusher of FIG. 19.
Figure 25:
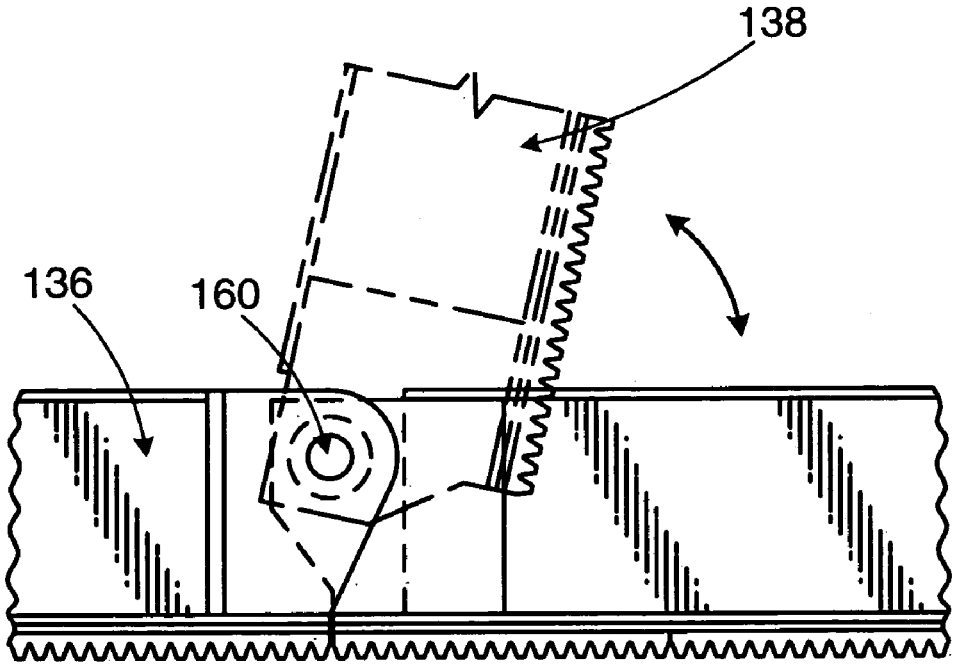

In order for the second arm section 138 to engage the gear 150, the second arm section 138 is pivotally connected to the first arm section 136 as by a pivot pin 160 as shown in FIGS. 24 and 25. Rotation of the second arm section 138 from the first position to the second position enables the second arm section 138 to engage the gear 150 as the extension arm 134 extends into the hot car 24 to push the coke slab 26 onto the quench car 34.

Figure 26:
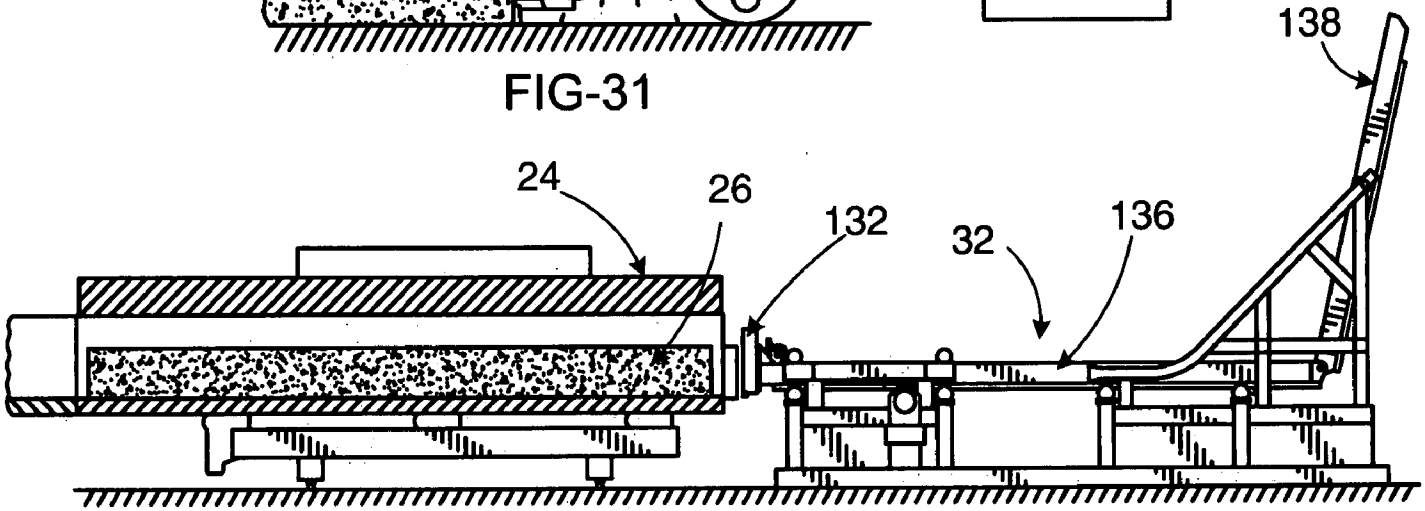
Figure 27:
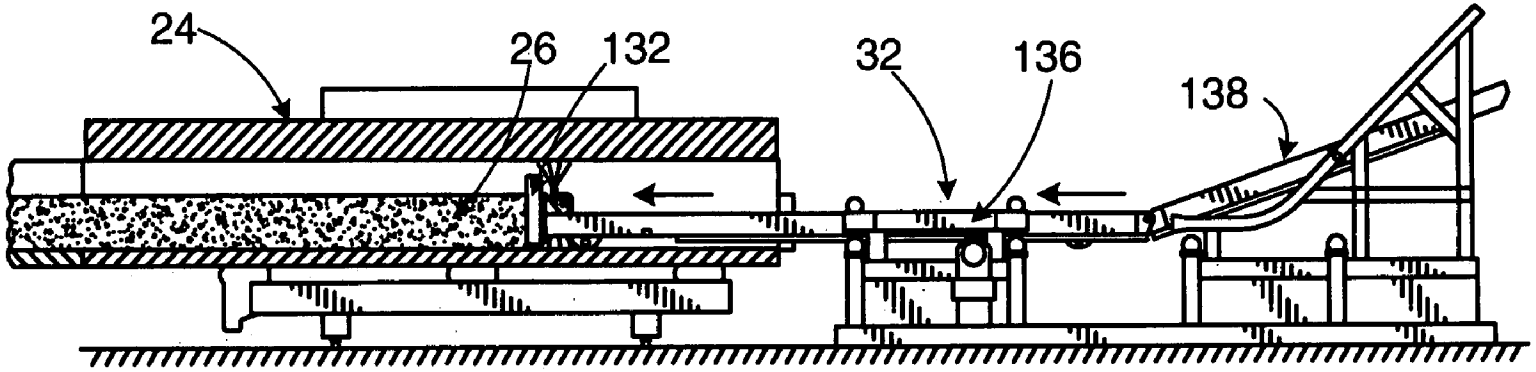
Figure 28:
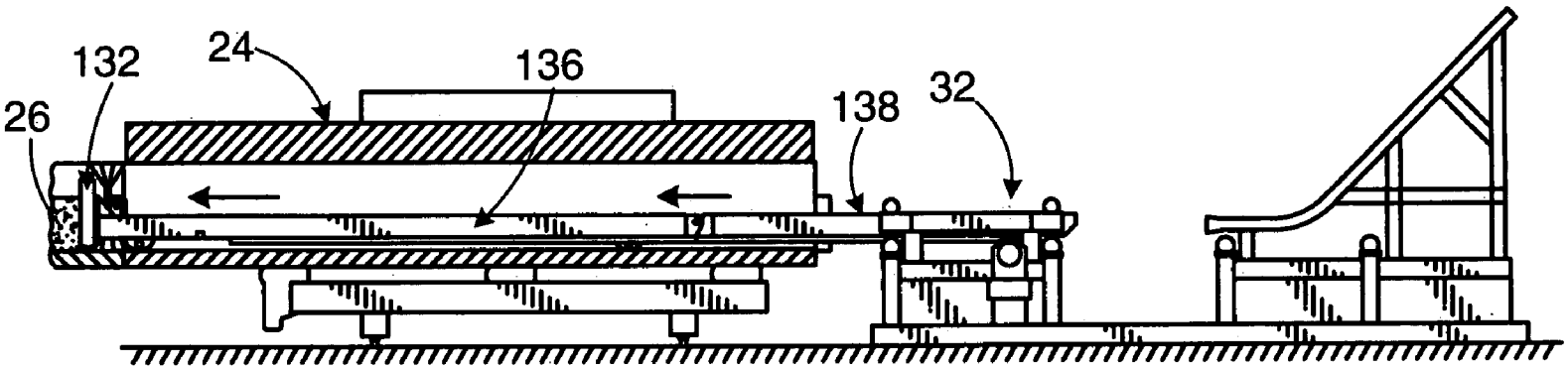

Extension and retraction movement of the fluid cooled ram head 132 is illustrated in FIGS. 26-30. In FIG. 26, the ram head 132 is in a first position adjacent a coke slab 26 in the hot car 24. Upon activation of the gear drive mechanism 144, the ram head 132 engages the coke slab 26 to move the slab 26 from the hot car 24 onto the quench car 34. In FIG. 27, only the first arm section 136 of the pusher 32 is in operative engagement with the gear drive mechanism 136 as the ram head 132 pushes the coke slab 26. In FIG. 28, the second arm section 138 is in operative engagement with the gear drive mechanism 144 so that the ram head 132 is fully extended through the hot car 24 and the coke slab 26 has been moved onto the quench car 34.

Figure 31:
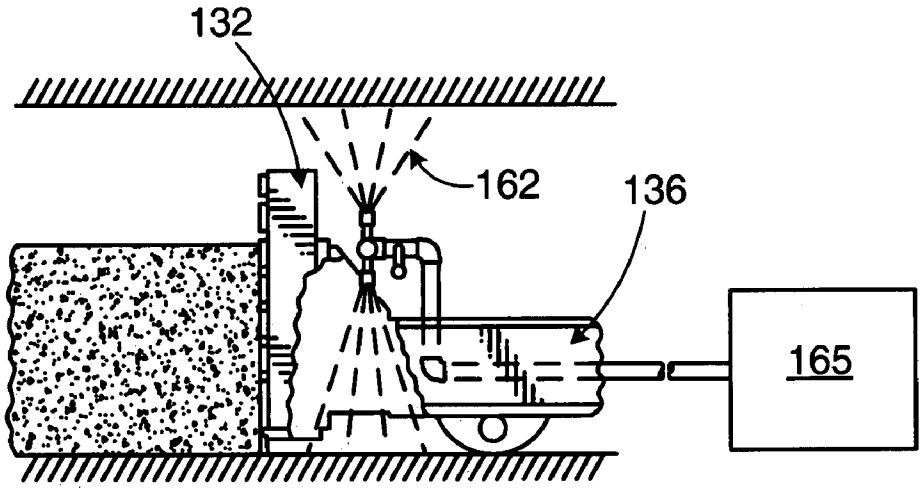
FIGS. 26-31 are schematic illustrations of the operation of the stationary pusher of FIG. 19.
Figure 29:
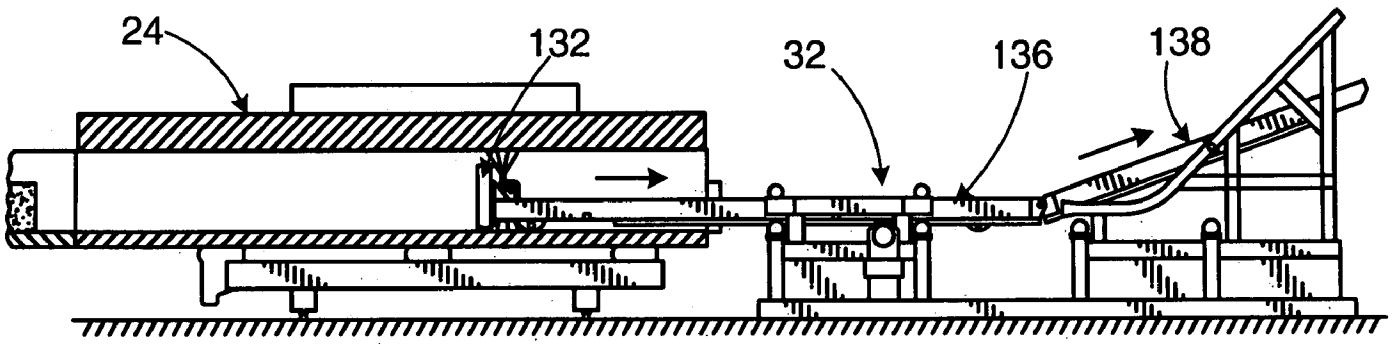
Figure 30:
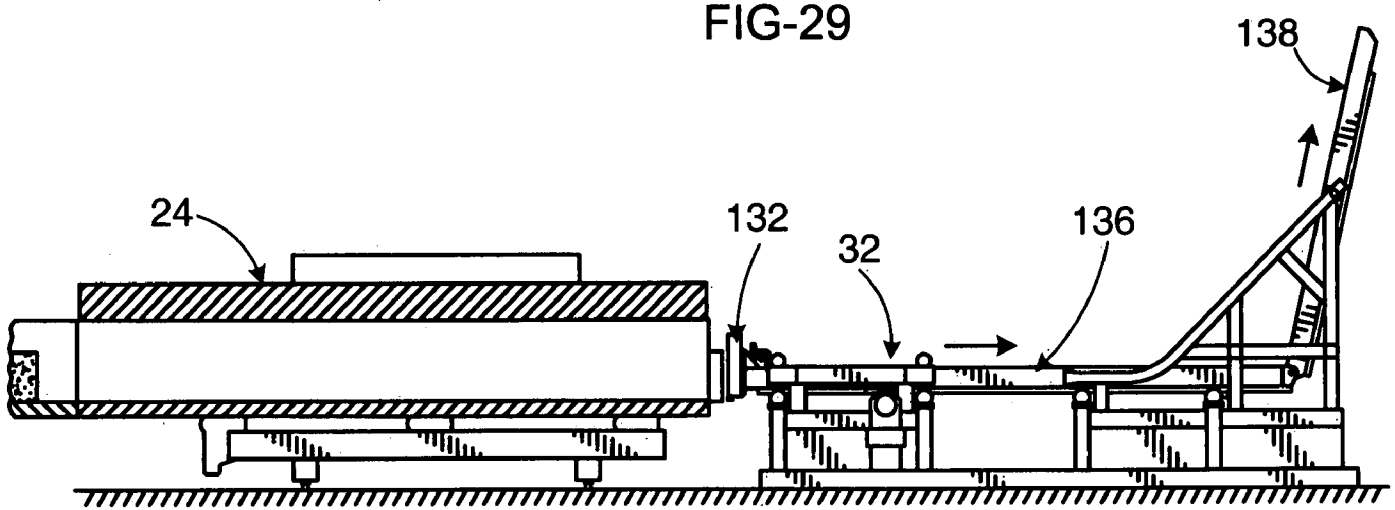
Figure 32:
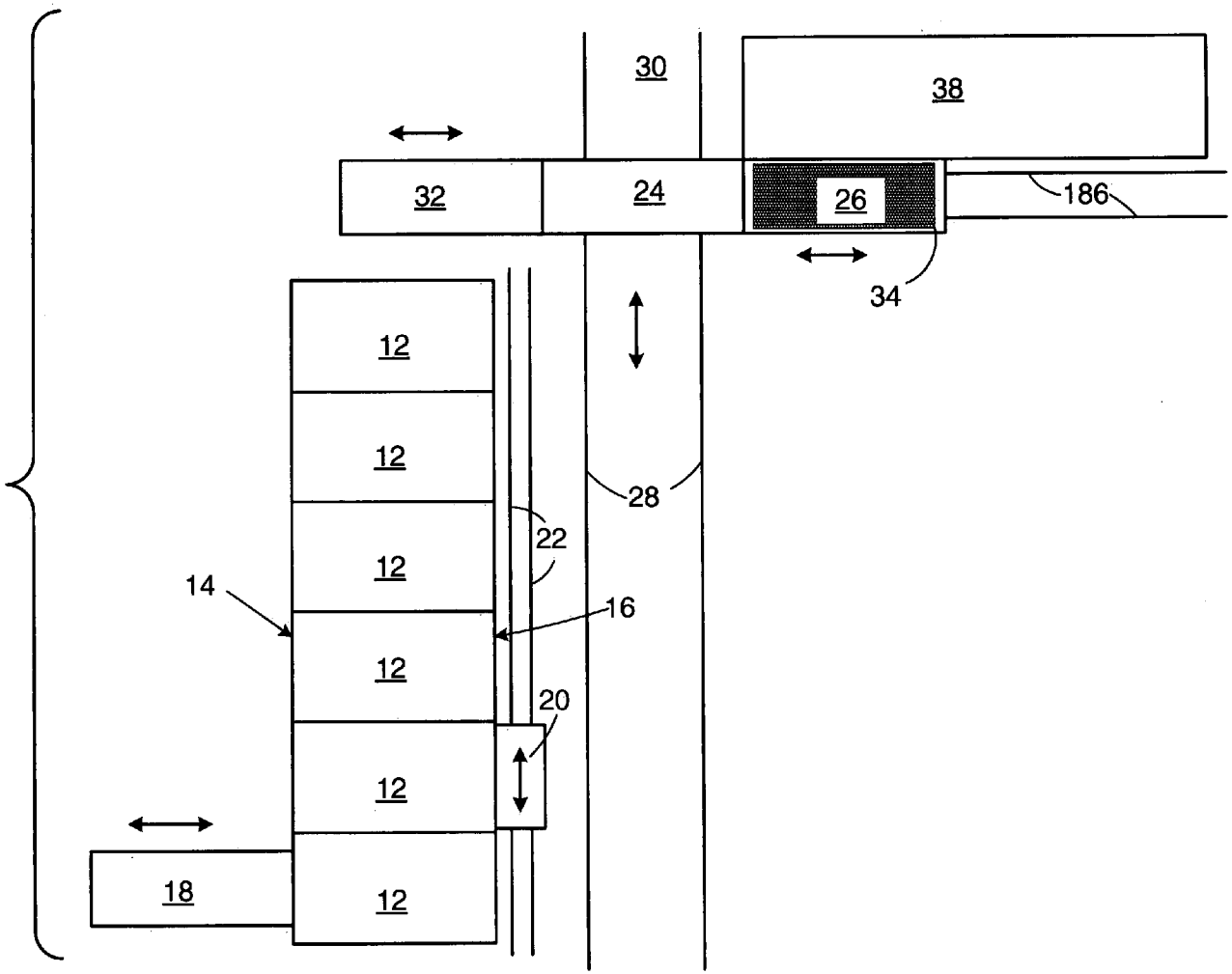
FIG. 32 is an overall plan view, not to scale, of a coke oven battery, quenching station, and associated equipment showing a coke slab on the quench car.
Figure 33:
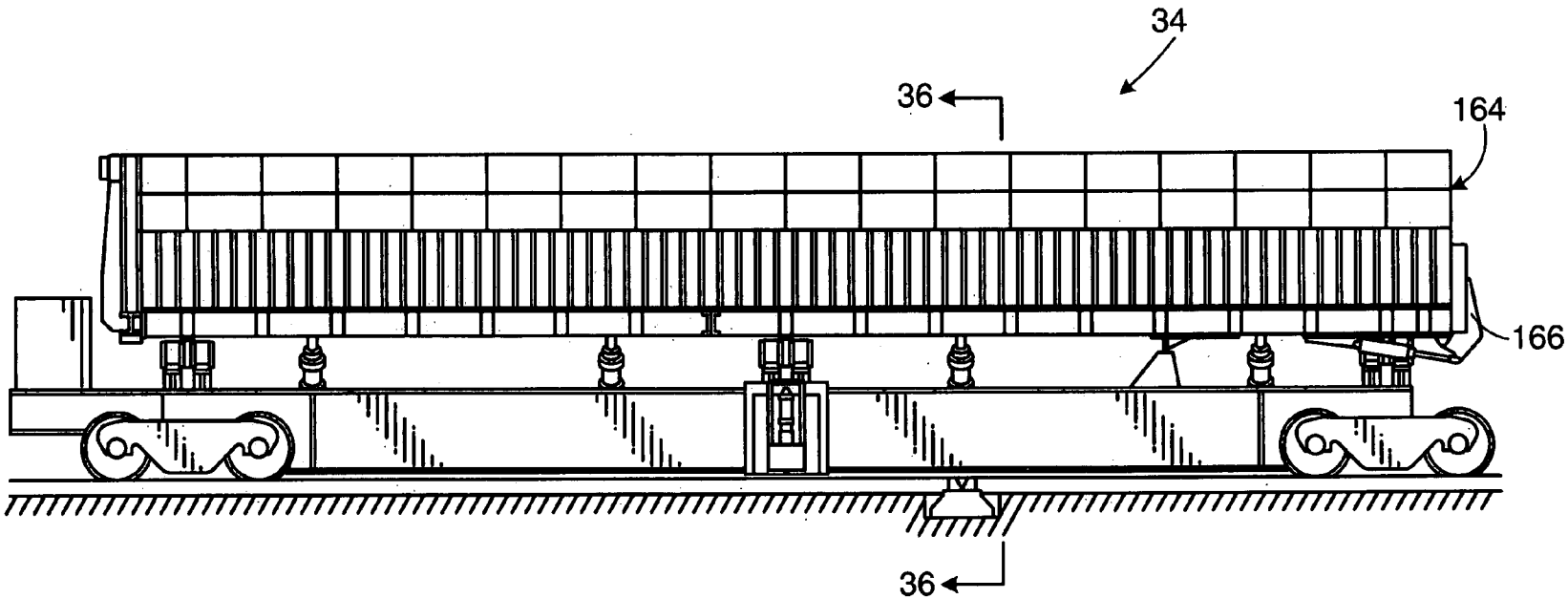
FIG. 33 is a side elevational view, not to scale, of a quench car according to an embodiment of the disclosure.

In FIGS. 29 and 30, the ram head 132 moves from the fully extended position in FIG. 28 to a retracted position as shown in FIG. 30. During movement of the ram head 132 in both directions, the cooling spray nozzle 140 is activated to provide a spray of cooling fluid 162 as shown in more detail in FIG. 31 to cool the hot car 24 and to prevent premature failure of the hot car 24 after multiple pushing cycles. A cooling fluid such as water is provided by a cooling fluid source 165 operatively connected to the cooling spray nozzle 140. It will be appreciated that the fluid cooled ram head 132 may be cooled using water or other cooling fluid from the same fluid source 165 or from a separate cooling fluid source. However, the cooling fluid 162 for the cooling spray nozzle 140 is desirably water which upon contact with hot surface of the hot car is converted to steam. Provisions are made to operate the pusher 32 either adjacent to the pusher 132 or remotely, as for example, by an operator in the operator housing 68 of the hot car 24. Once the coke slab 26 has been pushed onto the quench car 24 as shown in FIG. 32, the hot car 24 may return to adjacent another oven 12 to accept another coke slab 26.

With reference to FIGS. 33-42, details of the quench car 34 are illustrated. The quench car 34 is an elongate open top, multi-function device that is used for providing coke product having a predetermined moisture content. The quench car 24 has a coke slab inlet end 164 including a coke retainer gate 166 that may be lowered for moving the coke slab 26 onto the quench car 34 and raised to retain the coke slab 26 during quenching operations.

Figure 34:
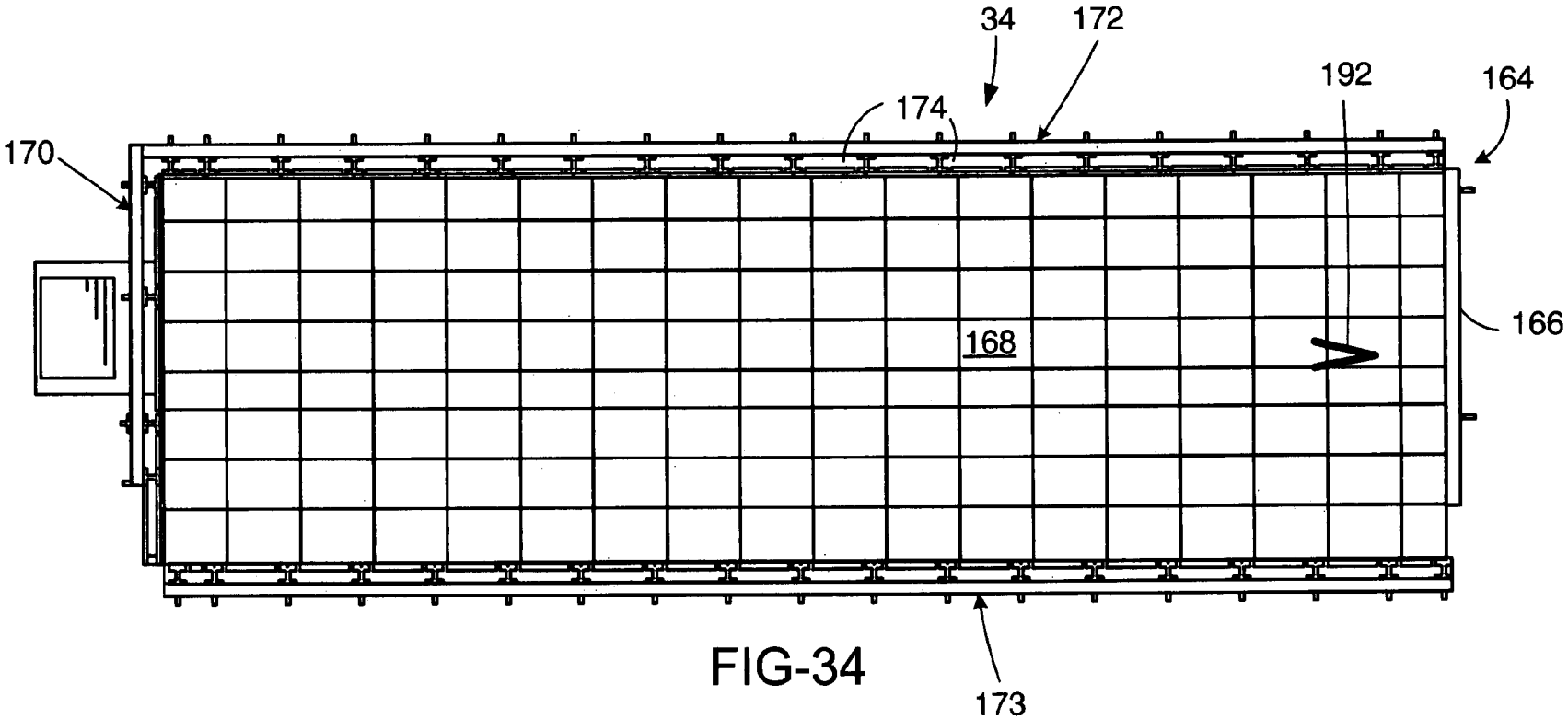
FIG. 34 is a top plan view, not to scale, of the quench car of FIG. 33.

As shown in plan view in FIG. 34, the quench car 34 has an elongate bed section 168 for accepting the coke slab 26, a fixed opposing end wall 170, a fixed side wall 172, and a movable side wall 173. As described in more detail below, the fixed side wall 172 has fluid drainage ports 174 for flow of quench fluid therethrough.

Figure 35:
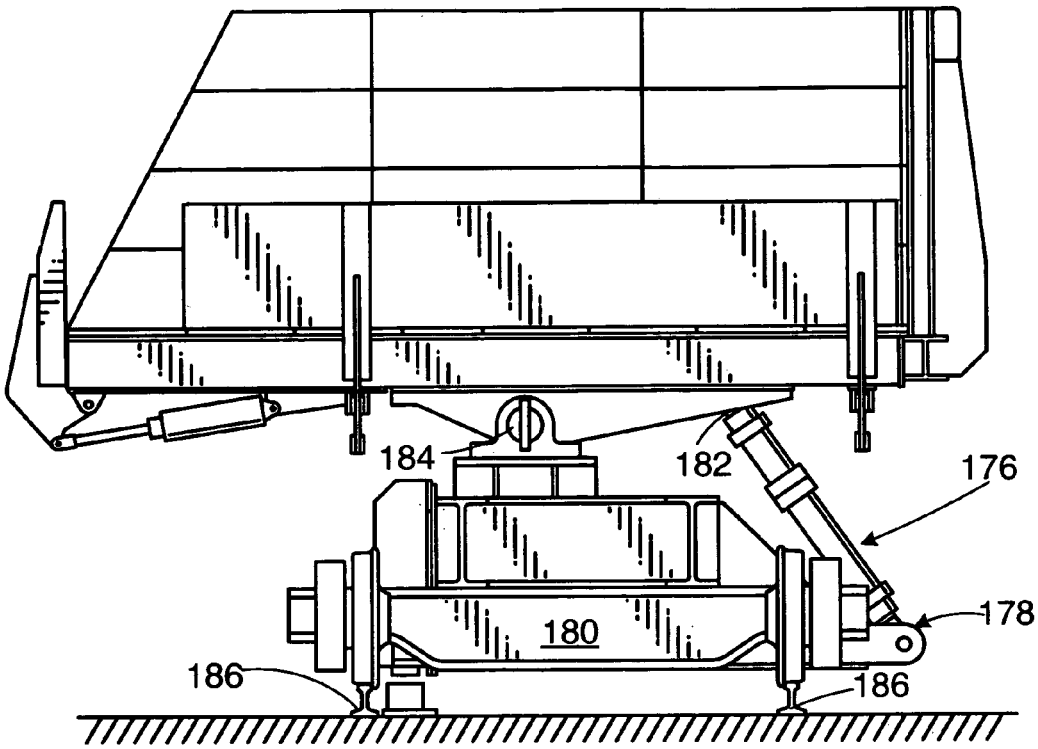
FIGS. 35-36 are end elevational views, not to scale, of the quench car of FIG. 33 illustrating details of a tilting mechanism.
Figure 36:
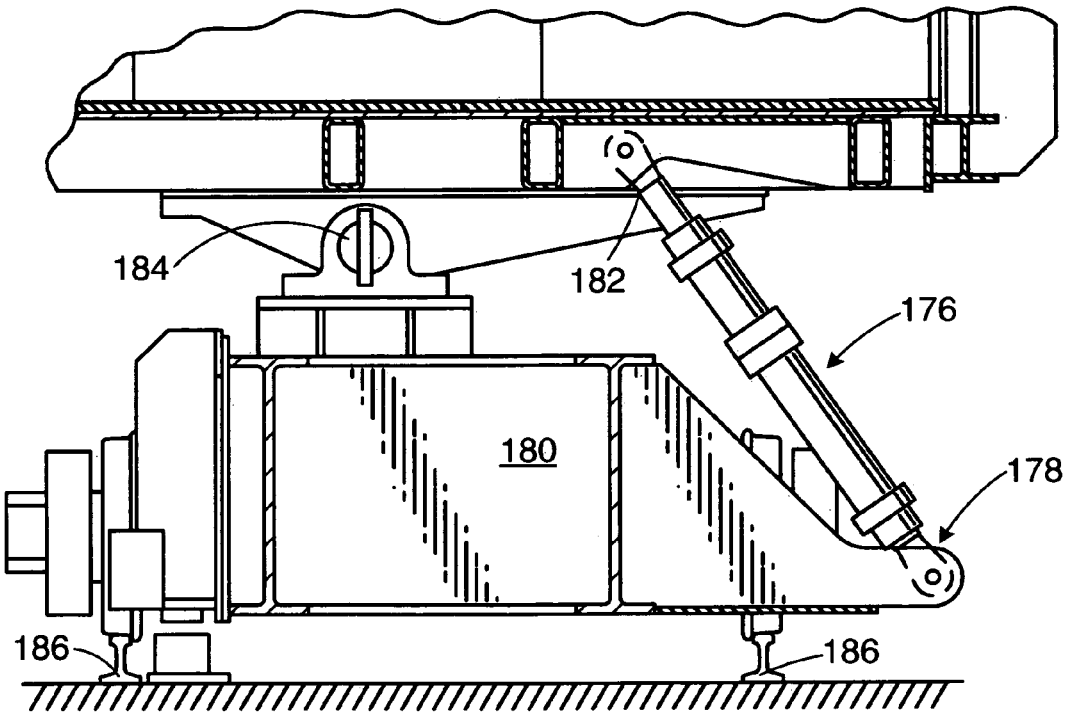
Figure 37:
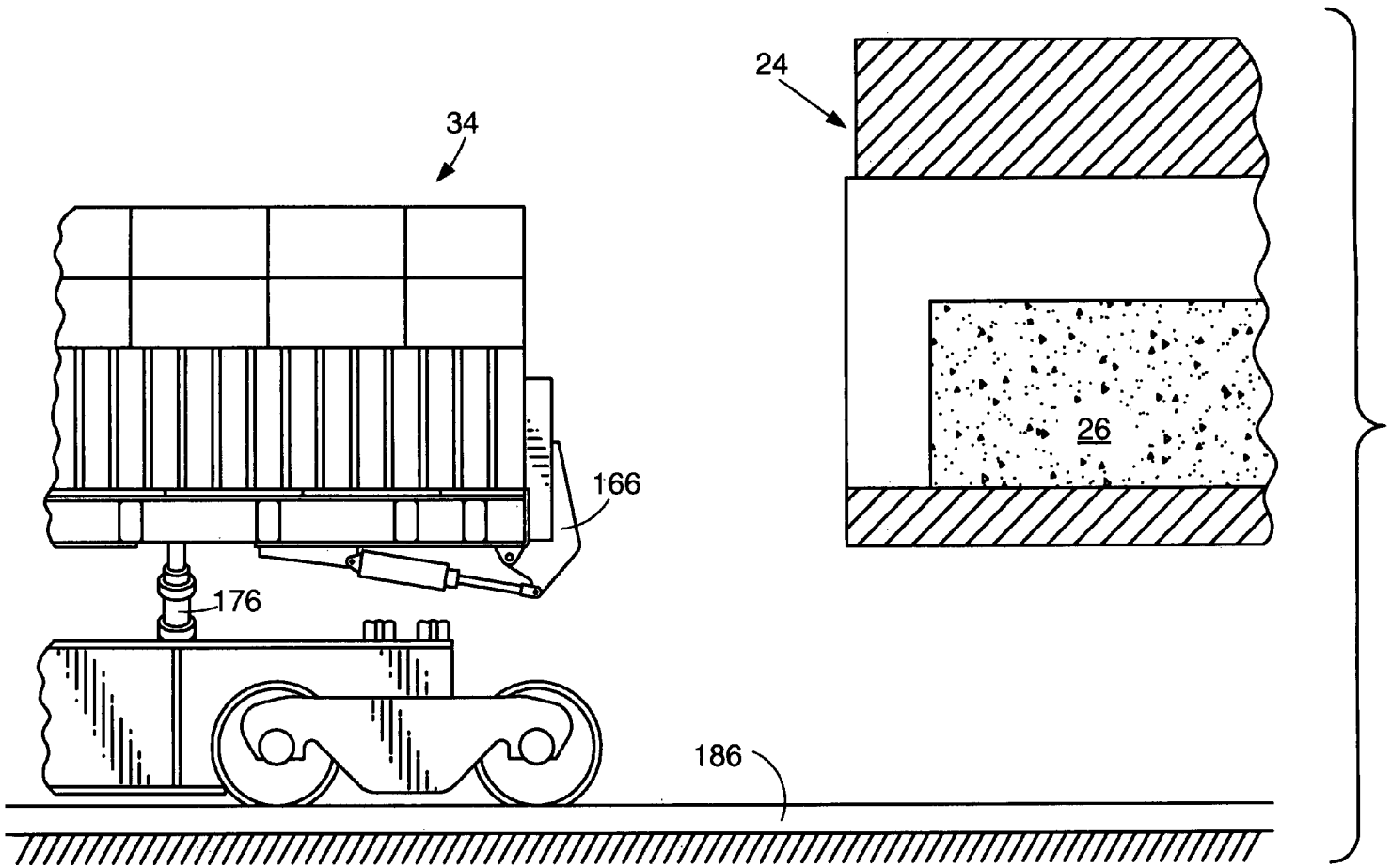
FIGS. 37-38 are side elevational views, not to scale, of the quench car of FIG. 33 in a first position relative to a hot car.
Figure 38:
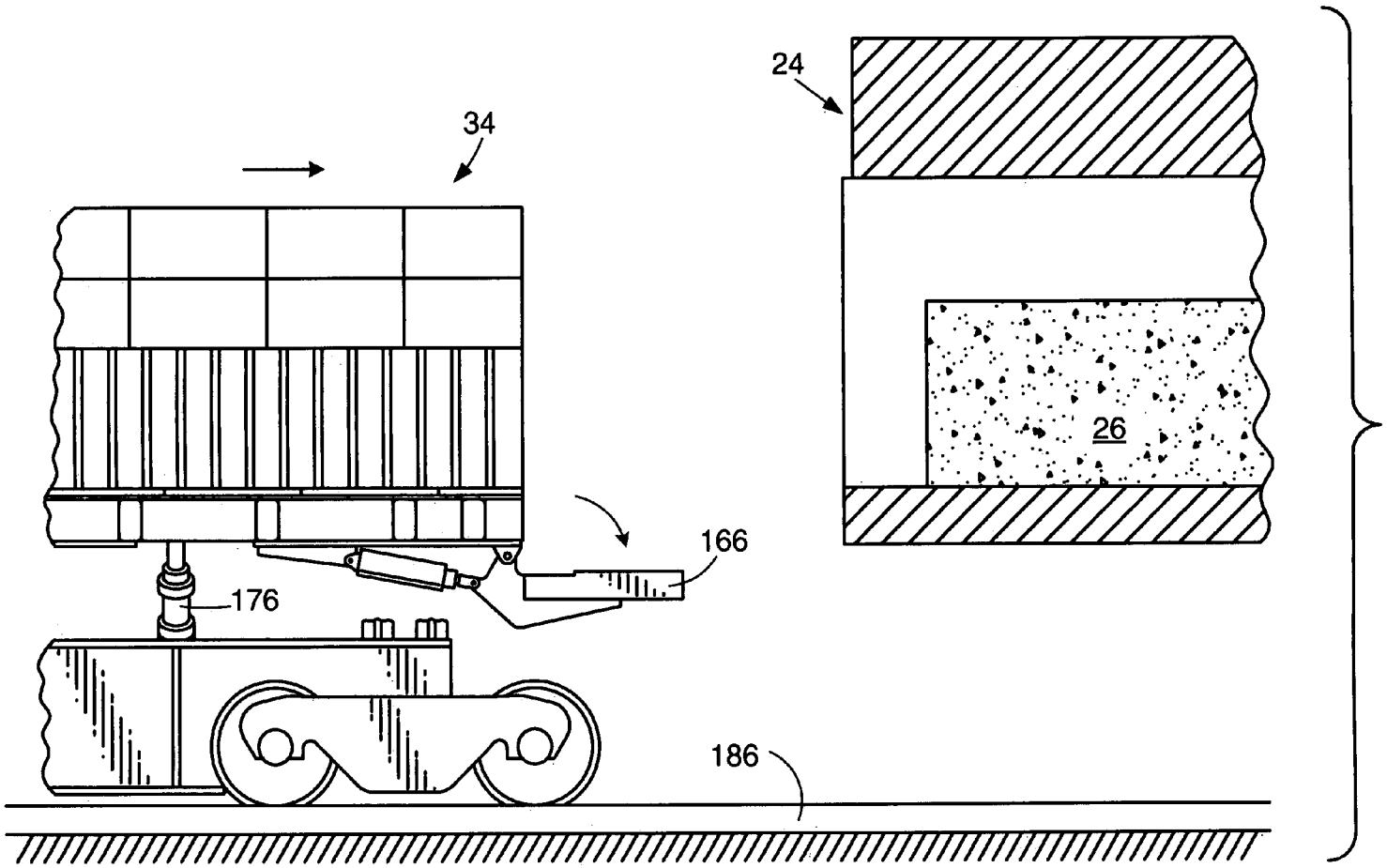
Figure 39:
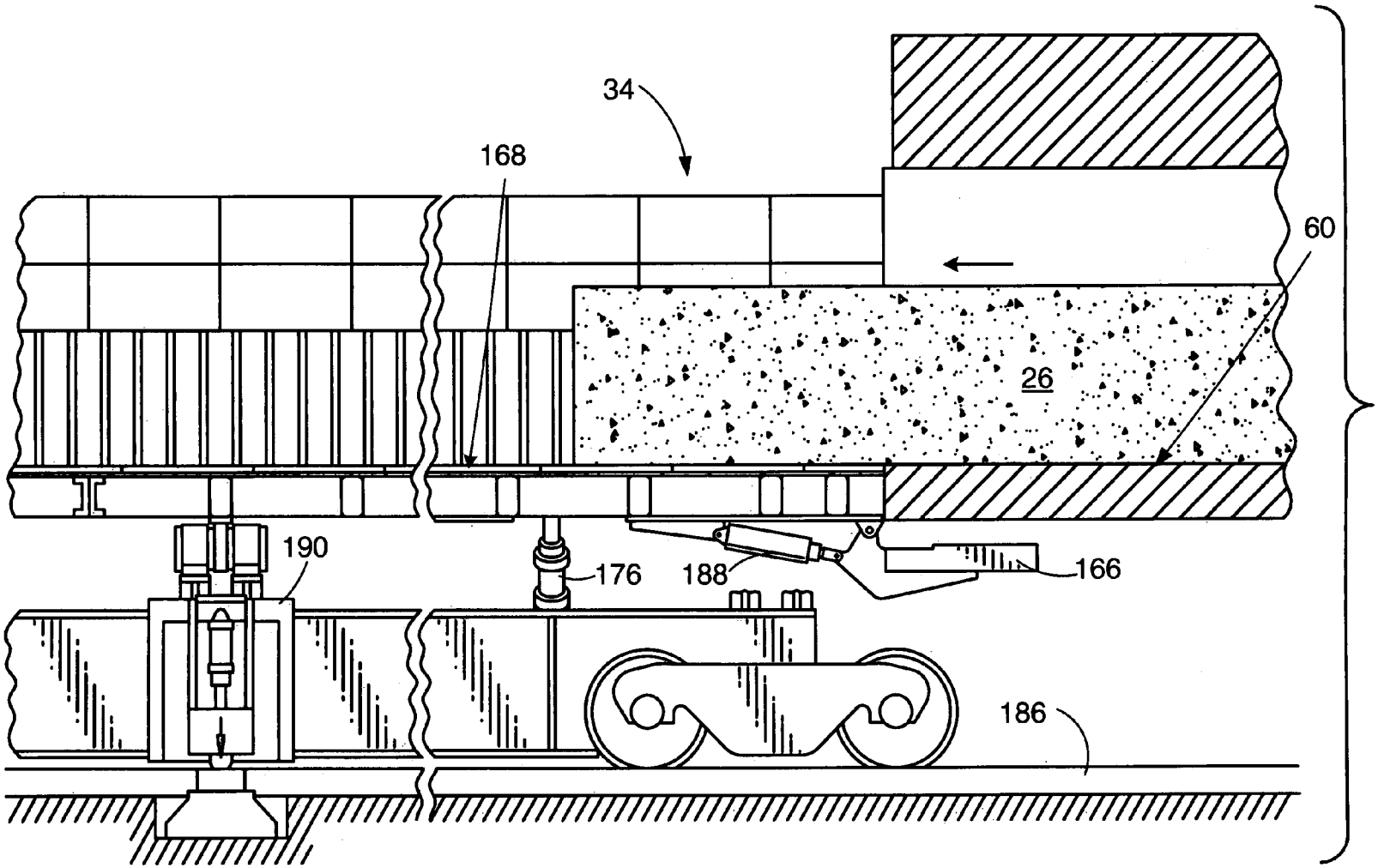
FIG. 39 is a schematic view of a step of pushing a coke slab onto the quench car.

The quench car 24 also includes a tilting mechanism 176 illustrated in FIGS. 35 and 36 for tilting the quench car 24 in a first direction for quenching the coke slab 26 and in a second direction for discharging the quenched coke onto the receiving dock 38. The tilting mechanism 176 is attached on a first end 178 to a quench car frame 180 and on a second end 182 to the elongate bed section 168. The elongate bed section 168 is pivotally attached to the frame 180 on a pivot arm 184.

As with the hot car 24, the quench car 34 may be positioned in the quench area 30 by movement along rails 186 in the quench area 30 adjacent the receiving dock 38. Prior to moving the coke slab 26 from the hot car 24 to the quench car 34, the coke retainer gate 166 is lowered from a first position illustrated in FIG. 37 to a second position illustrated in FIG. 38 by a gate actuator mechanism 188. Once the retainer gate 166 has been lowered to the second position, the quench car may be moved to adjacent the hot car to receive the coke slab 26 from the hot car 24 as described above and illustrated in FIG. 39.

A mechanical positioning device 190 may be provided on the quench car 34 to assure that the quench car 34 is in a suitable position adjacent the hot car 24 for receiving the coke slab 26. It will be appreciated that the hot car translation and elevation mechanism 46 may be used to provide for any elevational differences between the quench car bed section 168 and the floor 60 of the hot car.

During movement of the coke slab 26 onto the quench car 34, a coke slab splitting device 192 (FIG. 34) attached to the elongate bed section 168 adjacent the inlet end 164 of the quench car 34 is effective to split the coke slab 26 into at least two sections for quench fluid movement through the coke slab 26. The splitting device 192 is a wedged shaped steel structure about five to about fifteen inches long, desirably about ten inches, that extends upward from the bed section 168 from about five to about fifteen inches, typically about ten inches. As the coke slab 26 moves onto the quench car 34, the splitting device 192 causes fracturing of the coke slab 26 that extends through a thickness of the slab 26 opening fissures that enable quench fluid to channel from an upper portion of the slab 26 to a lower portion of the slab 26 for more effective quench of the slab 26.

Figure 40:
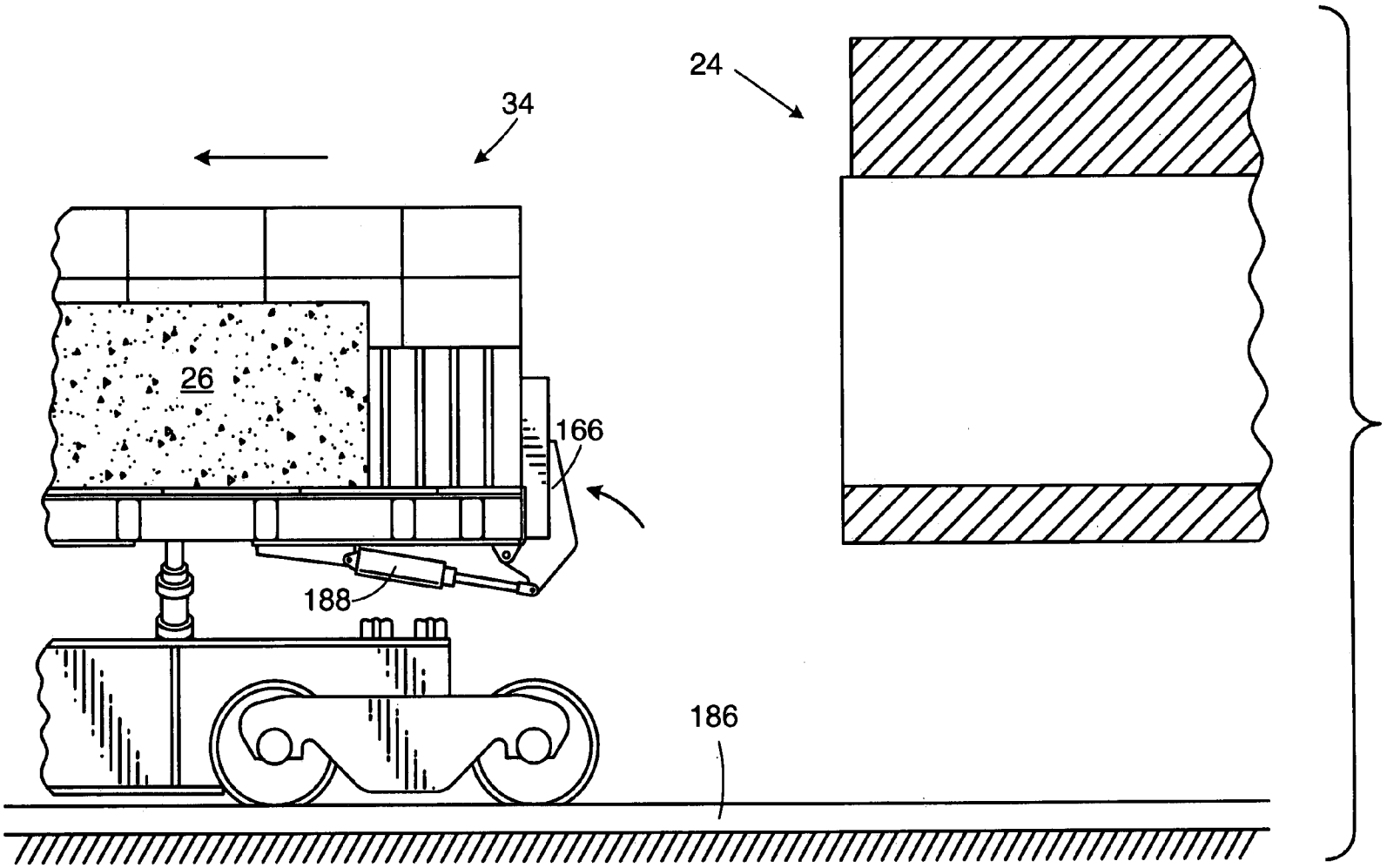
FIG. 40 is a side elevational view, not to scale, of the quench car of FIG. 33 after movement to a quenching position.
Figure 41:
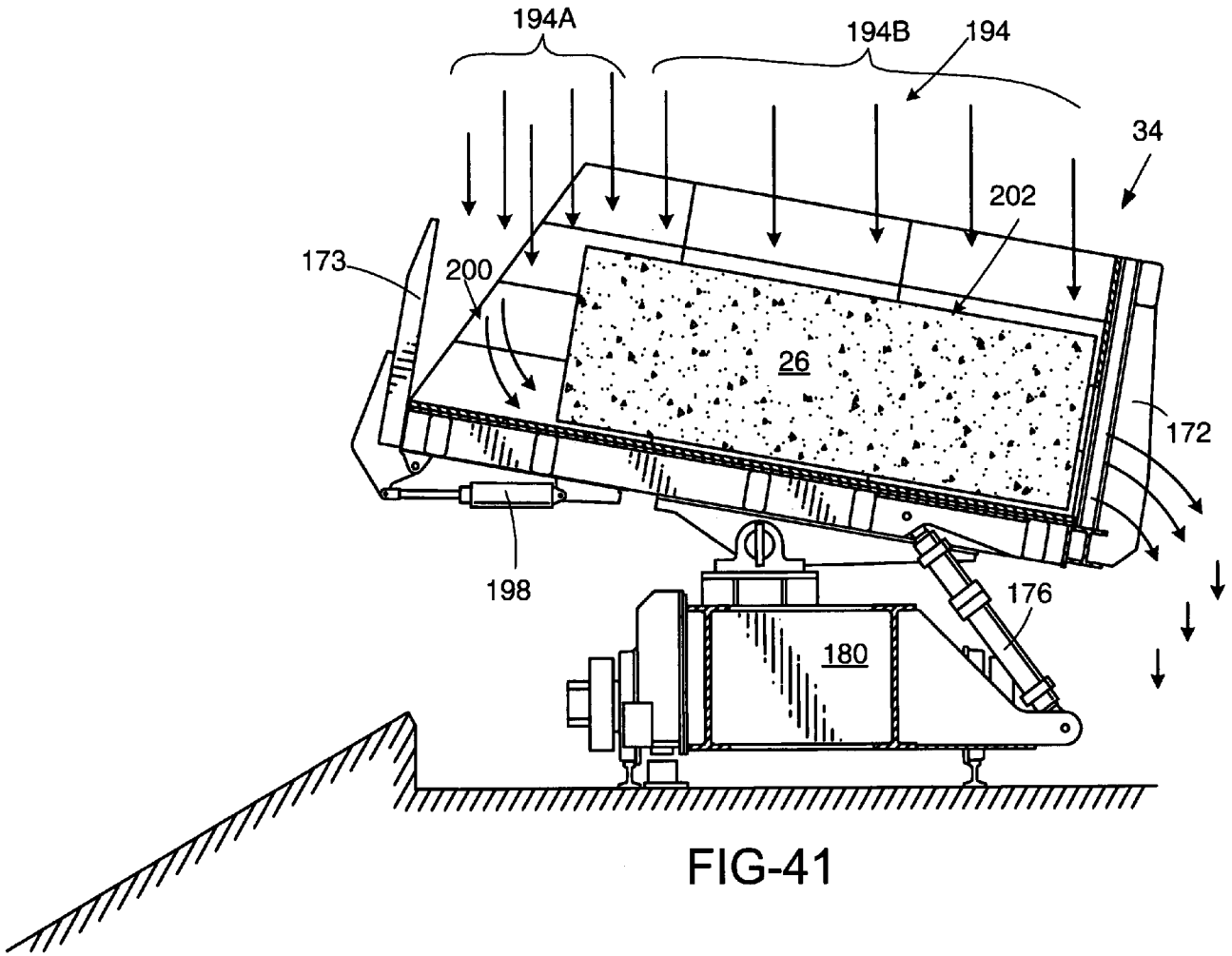
FIGS. 41-42 are schematic illustrations of a process for quenching and discharging a coke slab onto a receiving dock.
Figure 42:
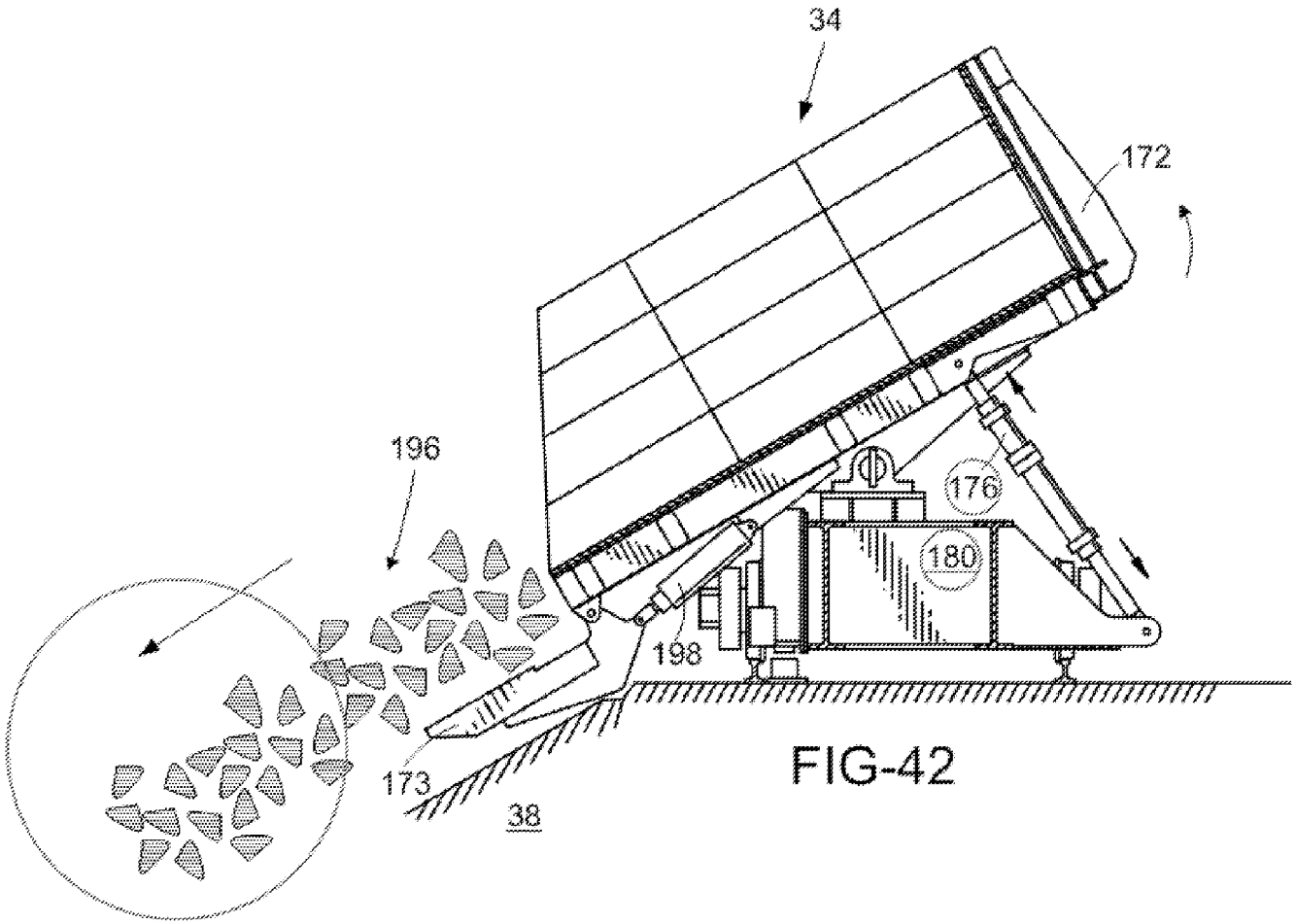

In FIG. 40, the gate actuator mechanism 188 is again activated to close the gate 166 and the quench car 34 is then moved away from the hot car into a quenching position. As shown in FIG. 41, when the quench car 34 has been positioned adjacent the receiving dock 38, the tilting mechanism 176 is activated to tilt the quench car 34 from about five to about fifteen degrees, typically about ten degrees, from a horizontal position for quenching flow of quench fluid 194 through, around and under the slab 26. During the quenching step, excess fluid flows through the drainage ports 174 in the side wall 172 and into a quench fluid collection pit opposite the receiving dock 38. Accordingly, substantially no quench fluid may spill onto the receiving dock 38. The flow of quench fluid 194 onto the coke slab 26 may be controlled automatically or manually by a control room operator and/or quench area operator.

A typical amount of quenching fluid suitable for quenching the coke slab 26 may range from about 1.5 to about 2.5 parts by weight water per part by weight coke. The quenching step is typically conducted as rapidly as possible and may range from about 1.5 to about 2.5 minutes total to provide coke having a moisture content of less than about 3.0 percent by weight, typically from about 1.5 to about 3.0 percent by weight.

As shown in FIG. 41, the quench fluid 194 may be provided by a single quench system or by a dual quench system indicated by arrows 194A and 194B. In the dual quench system, from about 50 to about 75 percent of the quench fluid is provided in the system indicated by arrows 194A to provide a suitable amount of quench fluid that can flow under the coke slab 26 as shown by arrows 200. Accordingly, the remaining portion of the quench from, from about 25 to about 50 percent by weight is directed to the top side 202 of the coke slab 26.

Upon completion of the quenching cycle, the tilting mechanism 176 is again actuated to cause the quench car 34 to tilt in an opposite direction from about twenty-five to about thirty-five degrees relative to a horizontal position for discharge of quenched coke 196 onto the receiving dock. Prior to discharging the quenched coke 196 coke, an actuator 198 attached to movable side wall 173 is activated to lower the movable side wall 173 for flow of quenched coke 196 from the quench car 34 onto the receiving dock 38. Upon discharging the quenched coke 196 from the quench car 34, the actuator mechanism 176 may then be actuated to return the quench car 34 to the coke slab receiving position, and actuator 198 may be actuated to raise the movable wall 173.

In the foregoing description, the entire apparatus with the exception of conveyor belts, electrical components and the like may be made of cast or forged steel. Accordingly, robust construction of the apparatus is possible and provides a relatively long lasting apparatus which is suitable for the coke oven environment.

Having described various aspects and embodiments of the invention and several advantages thereof, it will be recognized by those of ordinary skills that the invention is susceptible to various modifications, substitutions and revisions within the spirit and scope of the appended claims.

What is claimed is:

1. A method for quenching metallurgical coke made in a coking oven, the method comprising the steps of:
- pushing a unitary slab of hot coke onto a substantially planar receiving surface of a hot car;
- transporting the hot car to a quench car station;
- pushing the unitary slab of hot coke onto a substantially planar receiving surface of a quench car;
- quenching the slab of hot coke in the quench car with a predetermine amount of water;
- dumping the quenched coke onto a receiving pad for collection thereof.

2. The method of claim 1, wherein the hot car contains a cover and a dust collection system, further comprising collecting dust generated during the step of pushing the unitary slab of hot coke onto the surface of the hot car.

3. The method of claim 1, wherein the coke is quenched at a quenching station.

4. The method of claim 3, wherein the receiving pad for the quenched coke is adjacent to the quenching station.

5. The method of claim 1, further comprising splitting the coke slab as the coke slab is pushed onto the quench car.

6. The method of claim 1, wherein the quenching step is conducted under conditions sufficient to fracture substantially the entire unitary slab of coke.

7. The method of claim 1, further comprising longitudinally splitting the unitary slab of hot coke as the unitary slab is pushed onto the quench car.

8. A method of making coke from coal, the method comprising the steps of:
- burning a bed of coal in a coking oven for a period of time and under reducing atmosphere conditions to provide a unitary bed of coke;
- removing a product door from a product end of a first coking oven;
- positioning a hot car adjacent the product end of the first coking oven;
- pushing the unitary bed of hot coke onto a substantially planar receiving surface of the hot car;
- transporting the hot car containing the unitary bed of hot coke to a quenching car station;
- reinstalling the product door onto the product end of the first coking oven;
- pushing the unitary bed of hot coke onto a substantially planar receiving surface of a quench car;
- quenching the unitary bed of hot coke in the quench car with an amount of water sufficient to fracture substantially all of the unitary bed of hot coke and to cool the hot coke to a predetermined temperature; and
- dumping the quenched and cooled coke onto a coke receiving pad.

9. The method of claim 8, wherein the hot car contains a cover and a dust collection system, further comprising collecting dust generated during the step of pushing the unitary bed of hot coke onto the surface of the hot car.

10. The method of claim 8, wherein the receiving pad for the quenched coke is adjacent to the quenching station.

11. The method of claim 8, wherein the quenching car has a first tilted position for quenching the coke and a second tilted position for dumping the quenched coke, further comprising draining excess water from the unitary bed of hot coke during the quenching step by tilting the quench car to the first tilted position.

12. The method of claim 11, further comprising dumping the quenched and cooled coke onto the coke receiving pad by tilting the quench car to the second tilted position.

13. The method of claim 12, wherein the second tilted position is toward an opposite side of the quench car from the first tilted position.

14. The method of claim 8, further comprising positioning the hot car adjacent a product end of a second coke oven after pushing the bed of hot coke onto the receiving surface of the quench car.

15. A hot car for a coke oven, the hot car comprising,
- a partially enclosed hot box having a substantially planar coke slab receiving surface; and
- an elevation and translation mechanism for elevating the hot box and moving the hot box toward and away from the coke oven.

16. The hot car of claim 15, further comprising a dust collection system integrally attached to the hot car.

17. The hot car of claim 16, wherein the dust collection system further comprises a biased inlet duct slidably movable adjacent a blanking plate attached to an exit duct from the hot car.

18. The hot car of claim 16, wherein the hot car is movably positionable on tracks between a coke discharge end of the coke oven and a coke quench station.

19. A stationary pusher for pushing a substantially unitary coke slab off of a hot car onto a quench car, the pusher comprising:
- a water cooled ram head, a first arm attached to the ram head, and a second arm pivotally connected to the first arm;
- a gear drive mechanism for moving the first and second arms;
- a cooling spray system for cooling the hot car movably attached adjacent to the ram head; and
- a guiding track for guiding movement of the second arm from a substantially vertical position to a substantially horizontal position.

20. A multifunction quench car comprising:
- a tiltable receiving bed having a substantially fixed end wall, a substantially fixed side wall, a movable side wall and a movable end wall; and
- a tilting mechanism for tilting the receiving bed in a first direction for quenching coke and in a second direction for discharging quenched coke onto a coke receiving dock.

21. The quench car of claim 20, further comprising a coke slab splitter attached to the receiving bed adjacent a first end of the quench car.

22. The quench car of claim 20, wherein the receiving bed is tiltable in the first direction at an angle ranging from about 5 to about 15 degrees.

23. The quench car of claim 20, wherein the receiving bed is tiltable in the second direction at an angle ranging from about 25 to about 35 degrees.

24. The quench car of claim 20, wherein the car is movably positionable on tracks adjacent the receiving dock.

* * * * *